US012630344B2

(12) United States Patent
Pisarevsky

(10) Patent No.: US 12,630,344 B2
(45) Date of Patent: May 19, 2026

(54) SYSTEM AND METHOD FOR ATTACHING AN EXCHANGEABLE SEALING CAPS TO CONTAINERS

(71) Applicant: ADNART INC., Montreal (CA)

(72) Inventor: Arie Pisarevsky, Montreal (CA)

( * ) Notice: Subject to any disclaimer, the term of this patent is extended or adjusted under 35 U.S.C. 154(b) by 0 days.

(21) Appl. No.: 19/124,911

(22) PCT Filed: Oct. 16, 2024

(86) PCT No.: PCT/IB2024/060128
§ 371 (c)(1),
(2) Date: Apr. 28, 2025

(87) PCT Pub. No.: WO2025/083566
PCT Pub. Date: Apr. 24, 2025

(65) Prior Publication Data

US 2026/0008605 A1 Jan. 8, 2026

Related U.S. Application Data

(60) Provisional application No. 63/544,238, filed on Oct. 16, 2023, provisional application No. 63/561,335, (Continued)

(51) Int. Cl.
*B65D 51/24* (2006.01)
*A45F 3/16* (2006.01)
(Continued)

(52) U.S. Cl.
CPC ..... *B65D 51/248* (2013.01); *B65D 47/088* (2013.01); *B65D 51/242* (2013.01); (Continued)

(58) Field of Classification Search
CPC .. B65D 47/088; B65D 51/248; B65D 51/242; B65D 81/365; B65D 2231/022; B65D 2251/06; A45F 3/16
(Continued)

(56) References Cited

U.S. PATENT DOCUMENTS 5,337,918 A * 8/1994 Wang ..... A47G 19/2266 222/536
5,339,982 A * 8/1994 Tardie ..... A47G 19/2266 215/229
7,140,943 B1 * 11/2006 Hawkins ..... A63H 3/005 206/457
7,270,244 B1 9/2007 Liu
(Continued)

FOREIGN PATENT DOCUMENTS

EP 1502876 A1 2/2005

*Primary Examiner* — Luan K Bui
(74) *Attorney, Agent, or Firm* — AlphaPatent Associates Ltd.; Daniel J. Swirsky

(57) ABSTRACT

Systems for containing solid or liquid foodstuff are disclosed. An aspect of the system comprises a container configured to store the solid or liquid foodstuff. The container comprises an integral head coupler on its upper surface. The system also comprises a detachable head cap comprising an integral bottle coupler on its lower surface. The head coupler is configured to engage directly with the bottle coupler for mechanically connecting the detachable head cap to the container to seal the foodstuff thereof. The head coupler is configured to mechanically connect different head caps to the container. Optionally, the function of the detachable head cap is performed by two separate elements, a detachable head and a sealing cap.

1 Claim, 22 Drawing Sheets

Related U.S. Application Data filed on Mar. 5, 2024, provisional application No. 63/641,514, filed on May 2, 2024, provisional application No. 63/660,580, filed on Jun. 17, 2024, provisional application No. 63/680,212, filed on Aug. 7, 2024.

(51) Int. Cl.
*B65D 47/08* (2006.01)
*B65D 81/36* (2006.01)

(52) U.S. Cl.
CPC ..... *B65D 81/365* (2013.01); *B65D 2231/022* (2013.01); *B65D 2251/06* (2013.01)

(58) Field of Classification Search
USPC ..... 206/217, 457; 215/229, 316, 320, 329, 215/388; 220/212, 705, 706, 708, 709
See application file for complete search history.

(56) References Cited

U.S. PATENT DOCUMENTS

| | | | | |
|---|---|---|---|---|
| 8,376,165 | B2 * | 2/2013 | Chiang | B65D 51/1644 220/360 |
| 8,544,676 | B2 * | 10/2013 | Roth | A47G 19/2266 215/229 |
| 2002/0104933 | A1 | 8/2002 | Fishler | |
| 2006/0226110 | A1 | 10/2006 | Choi et al. | |
| 2007/0045217 | A1 | 3/2007 | Cho | |
| 2007/0267384 | A1 | 11/2007 | Field | |
| 2012/0234789 | A1 | 9/2012 | Mason | |
| 2012/0312832 | A1 | 12/2012 | Lane | |
| 2012/0322337 | A1 | 12/2012 | Theodory | |
| 2014/0116978 | A1 | 5/2014 | Khan | |
| 2015/0305530 | A1 * | 10/2015 | Winthrop | B65D 47/06 215/386 |
| 2018/0162582 | A1 | 6/2018 | Deylamian et al. | |
| 2020/0093313 | A1 | 3/2020 | Larsen | |
| 2021/0331842 | A1 | 10/2021 | Wong et al. | |

* cited by examiner

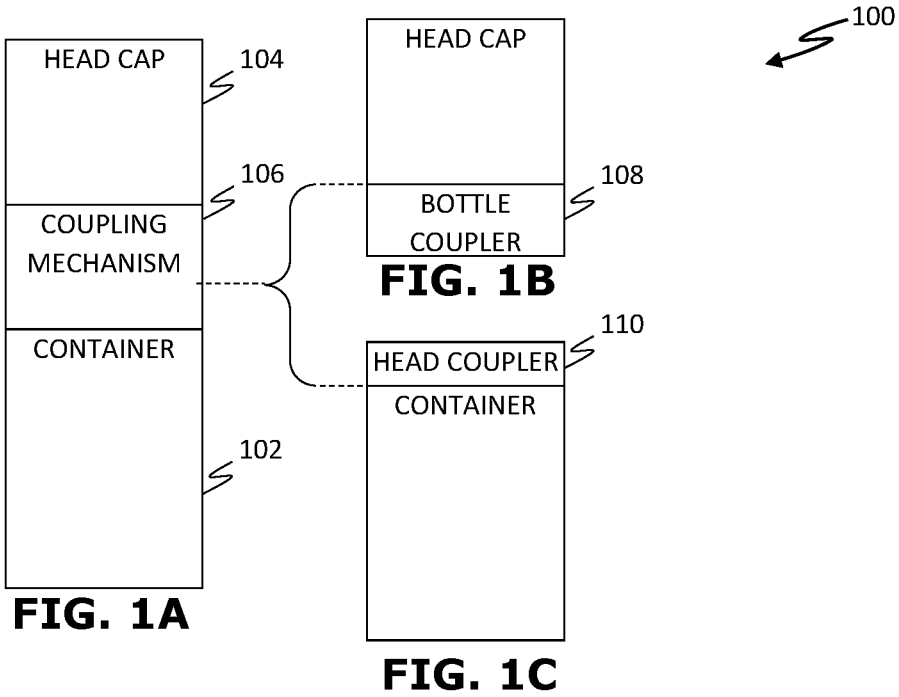
FIG. 1A
FIG. 1B
FIG. 1C
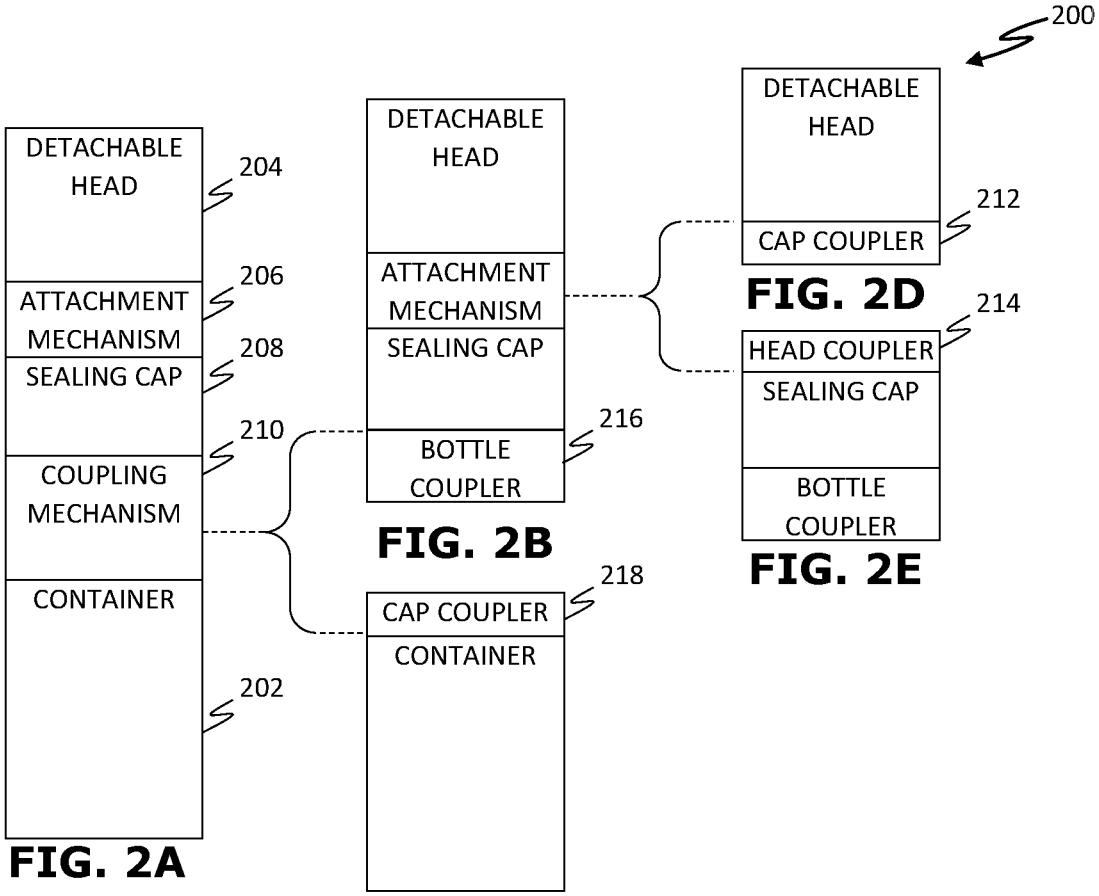
FIG. 2A
FIG. 2B
FIG. 2C
FIG. 2D
FIG. 2E

SYSTEM AND METHOD FOR ATTACHING AN EXCHANGEABLE SEALING CAPS TO CONTAINERS

CROSS-REFERENCE TO RELATED APPLICATIONS

This application is a U.S. National Phase Application under 35 U.S.C. 371 of International Application No. PCT/IB2024/060128, which has an international filing date of Oct. 16, 2024, and which claims the benefit of priority from U.S. Provisional Patent Application No. 63/544,238, filed Oct. 16, 2023, U.S. Provisional Patent Application No. 63/561,335, filed Mar. 5, 2024, U.S. Provisional Patent Application No. 63/641,514, filed May 2, 2024, U.S. Provisional Patent Application No. 63/660,580, filed Jun. 17, 2024, and U.S. Provisional Patent Application No. 63/680,212, filed Aug. 7, 2024, the contents of which are incorporated herein by reference in their entirety.

TECHNICAL FIELD AND BACKGROUND OF THE INVENTION

The invention relates generally to systems and methods for sealing containers and more specifically to attachment of exchangeable sealing caps to fluid containers.

Sufficient fluid intake is essential to good health, and its benefits extend far beyond mere hydration. It is recommended for people to drink an adequate amount of water for a number of reasons including for temperature regulation and for maintaining cell function and Survival.

Water constitutes 50% to 70% of human body weight and is a fundamental component of every cell, tissue, and organ. It plays a crucial role in maintaining cellular function and overall health as well as managing the removal of bodily waste. Water is essential for regulating body temperature. Sweating to reduce a hot body requires upon adequate hydration.

Water also aids digestion carrying essential nutrients around the body and helping to eliminate waste products from the body through processes like urination, perspiration, and bowel movements. Proper hydration ensures efficient waste removal, preventing the buildup of toxins. Furthermore, proper hydration keeps joints lubricated, reducing friction and promoting smooth movement, acting as a protective barrier for sensitive tissues and cushioning vital organs.

Moreover, even mild dehydration can lead to fatigue and decreased energy levels. Staying hydrated ensures optimal physical performance.

Children are more prone to dehydration than adults due to factors like their higher surface area to volume ratio than adults as well as their biological processes using more water, less efficient kidney function, and a higher proportion of body weight being water.

Although children require fluids as much as adults do, they may not recognize thirst because their awareness mechanism has not fully developed yet and they often rely on adults to remind them to drink and to provide them with water.

Accordingly, there is a need to incentivize children to hydrate. The current invention addresses this need.

SUMMARY OF THE EMBODIMENTS

In one aspect of the invention, a container system configured to contain solid or liquid foodstuff is disclosed. The container system comprises a container configured to store the solid or liquid foodstuff, wherein the container comprises an integral head coupler on its upper surface and a detachable head cap comprising an integral bottle coupler on its lower surface. The head coupler is configured to engage directly with a bottle coupler for mechanically connecting the detachable head cap to the container to seal the foodstuff thereof.

According to another aspect, container system further comprises an inner layer, an outer layer and an insulation layer between the inner and the outer layer, wherein the insulation layer prevents the transfer between the foodstuff inside the container and the external environment.

As appropriate, the head coupler is configured to mechanically connect different head caps to the container.

As appropriate, a coupling mechanism for connecting head coupler to the bottle coupler comprises one or more of a screw thread mechanism, male-female push connectors, non-binary connectors, clips, studs, fasteners, magnetic pins, vacuum seals, hook-and-eye connectors, high friction surfaces and combinations thereof.

As appropriate, the detachable head cap is formed from a soft flexible material.

As appropriate, the detachable head cap is formed from an odorless or pleasant odor material.

According to a further aspect, the container system further comprises a gripping ring configured for tightening grip between the bottle coupler and the head coupler.

As appropriate, the detachable head cap comprises an attractive feature.

As appropriate, the attractive feature comprises one or more of aesthetic looks, soft material, odor, functionality, design, shape, printed affiliative symbols or images, attachments, and combinations thereof.

As appropriate, the detachable head cap resembles the shape of a living or a non-living being.

As appropriate, the detachable head cap further comprises a closable drinking aperture for easy access to the foodstuff stored within the container.

As appropriate, the closable drinking aperture comprises a sipper aperture section, a drinking straw section or a combination thereof.

As appropriate, the detachable head cap further comprises a carrying handle configured for easy carrying the container system.

As appropriate, the detachable head cap further comprises an orientation element configured for correct alignment of the detachable head with respect to the carrying handle.

As appropriate, the container comprises a stabilization element at its bottom surface, wherein the stabilization element has a high coefficient of friction with respect to the ground surfaces.

According to a further aspect, the container system further comprises an attachment element for attaching the container system to another object.

As appropriate, the attachment element is a part of the container or the detachable head cap.

As appropriate, the container comprises a straw retention mechanism for holding a drinking straw in place within the container.

As appropriate, the detachable head cap comprises a recess into which a flexible upper section of a drinking straw may be folded when the head cap is closed over the container.

As appropriate, the detachable head cap further comprises a drinking nozzle protruding from its above surface for access to the contained foodstuff.

As appropriate, the container system is covered with a fluffy filling and an outer skin layer to form a soft object or a toy.

According to another aspect of the invention, a container system configured to contain solid or liquid foodstuff is disclosed. The container system comprises a container configured to store the solid or liquid foodstuff, wherein the container comprises an integral container cap coupler. The container system also comprises a sealing cap which comprises a bottle coupler integral to the lower part of the sealing cap, wherein the bottle coupler is configured for mechanically connecting to the container cap coupler to form a watertight seal for the container and head coupler integral to the upper part of the sealing cap. The container system further comprises a detachable head comprising a head cap coupler integral to the lower part of the detachable head, wherein the head cap coupler is configured for mechanically connecting to the head coupler of the sealing cap.

As appropriate, a coupling mechanism for connecting bottle coupler to the container cap coupler comprises one or more of a screw thread mechanism, male-female push connectors, non-binary connectors, clips, studs, fasteners, magnetic pins, vacuum seals, hook-and-eye connectors, high friction surfaces and combinations thereof.

As appropriate, a coupling mechanism for connecting head cap coupler to the head coupler comprises one or more of a screw thread mechanism, male-female push connectors, non-binary connectors, clips, studs, fasteners, magnetic pins, vacuum seals, hook-and-eye connectors, high friction surfaces and combinations thereof.

As appropriate, the detachable head is formed from a soft flexible material.

As appropriate, the detachable head is formed from an odorless or pleasant odor material.

According to a further aspect, the container system comprises a gripping ring configured for tightening grip between the head cap coupler and the head coupler.

As appropriate, the detachable head comprises an attractive feature.

As appropriate, the attractive feature comprises one or more of aesthetic looks, soft material, odor, functionality, design, shape, printed affiliative symbols or images, attachments, and combinations thereof.

As appropriate, the detachable head resembles the shape of a living or a non-living being.

As appropriate, the head cap coupler is configured to mechanically connect different detachable heads to the sealing cap.

According to another aspect, the detachable head further comprises a closable drinking aperture for easy access to the foodstuff stored within the container.

As appropriate, the closable drinking aperture comprises a sipper aperture section, a drinking straw section or a combination thereof.

As appropriate, the detachable head further comprises a carrying handle configured for easy carrying the container system.

As appropriate, the detachable head further comprises an orientation element configured for correct alignment of the detachable head with respect to the carrying handle.

As appropriate, the container comprises a stabilization element at its bottom surface, wherein the stabilization element has a high coefficient of friction with respect to the ground surfaces.

According to yet another aspect, the container system further comprises an attachment element for attaching the container system to another object.

As appropriate, the attachment element is a part of the container, sealing cap or the detachable head.

As appropriate, the container comprises a straw retention mechanism for holding a drinking straw in place within the container.

As appropriate, the sealing cap comprises a recess into which a flexible upper section of a drinking straw may be folded when the sealing cap is closed over the container.

As appropriate, the detachable head further comprises a drinking nozzle protruding from its above surface for access to the contained foodstuff.

As appropriate, the container system is covered with a fluffy filling and an outer skin layer to form a soft object or a toy.

BRIEF DESCRIPTION OF THE INVENTION

For a better understanding of the embodiments and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments only, and are presented in the cause of providing what is believed to be the most useful and readily understood description of the principles and conceptual aspects. In this regard, no attempt is made to show structural details in more detail than is necessary for a fundamental understanding; the description taken with the drawings making apparent to those skilled in the art how the various selected embodiments may be put into practice. In the accompanying drawings:

FIG. 1A is a block diagram representing selected elements of a system for attaching an exchangeable head cap to a beverage container according to a first embodiment of the current invention;

FIG. 1B is a block diagram representing the selected elements of the exchangeable head cap for attaching to the first beverage container according to an embodiment of the current invention;

FIG. 1C is a block diagram representing selected elements of a beverage container for attaching to a head cap according to the first embodiment of the current invention;

FIG. 2A is a block diagram representing selected elements of a system for attaching an exchangeable head cap to beverage container according to a second embodiment of the current invention;

FIG. 2B is a block diagram representing the selected elements of the exchangeable head cap including a detachable head and a sealing cap for attaching to a beverage container according to the second embodiment of the current invention;

FIG. 2C is a block diagram representing selected elements of the beverage container for attaching to a head cap according to the second embodiment of the current invention;

FIG. 2D is a block diagram representing the selected elements of a detachable head for connecting to a sealing cap according to the second embodiment of the current invention;

FIG. 2E is a block diagram representing the selected elements of a sealing cap for connecting to a detachable head the second embodiment of the current invention;

Figure 4A:
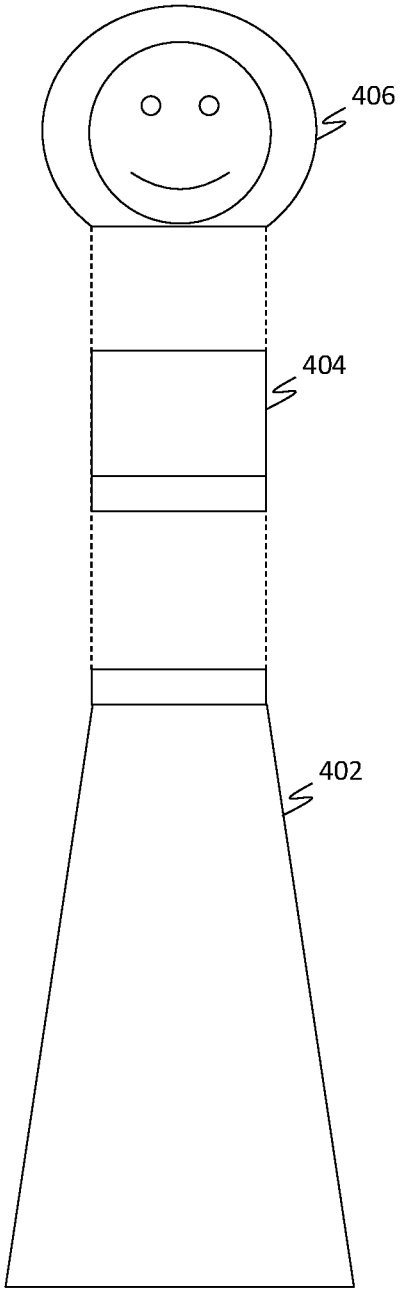
Figure 4B:
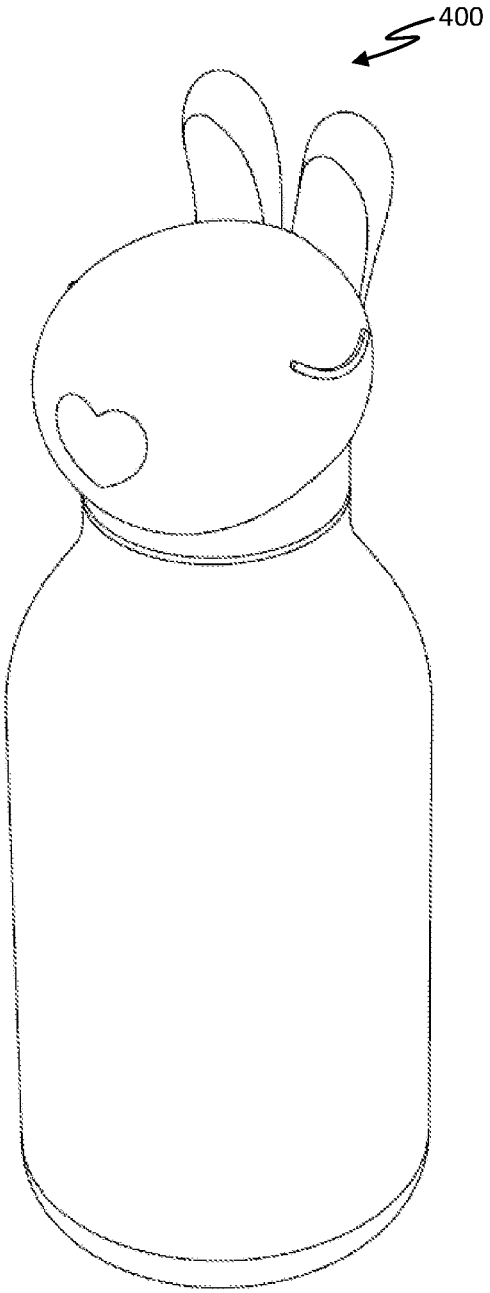
Figure 4C:
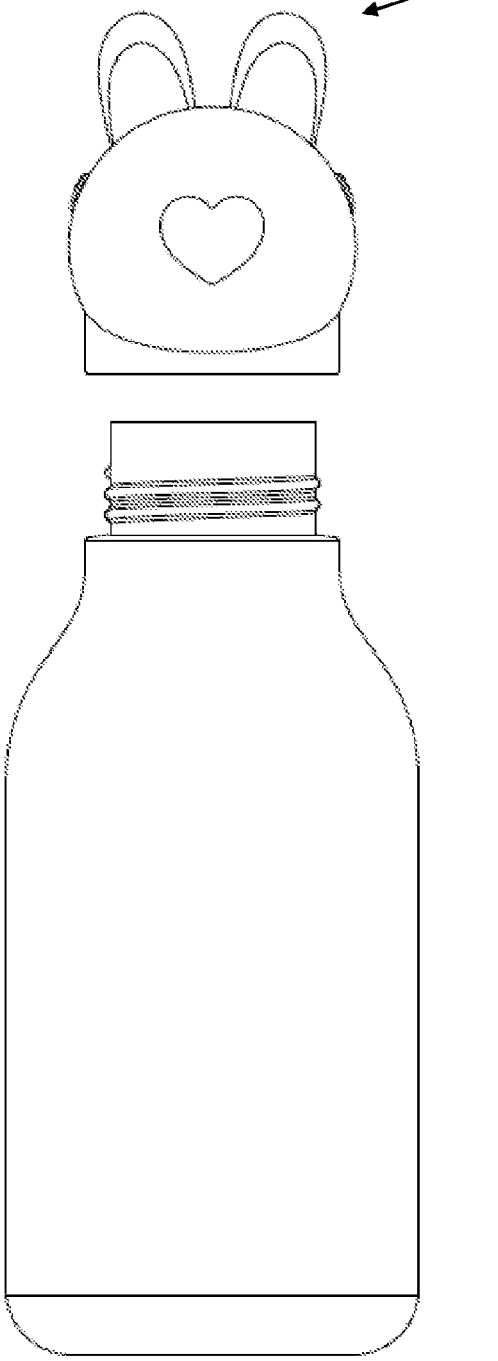
Figure 4D:
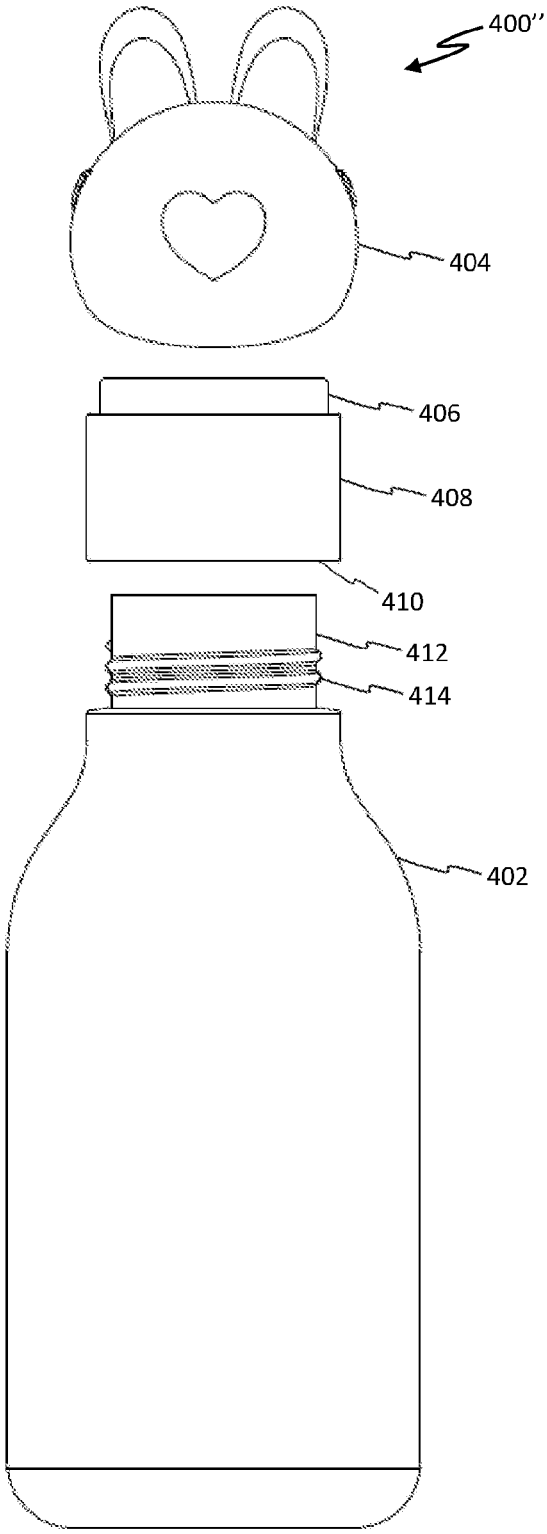
Figure 4E:
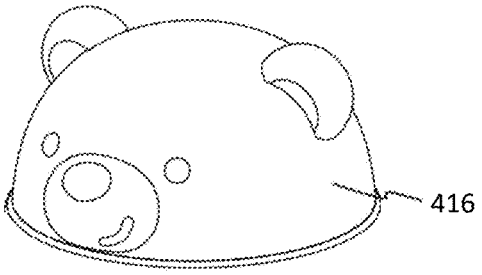
Figure 4G:
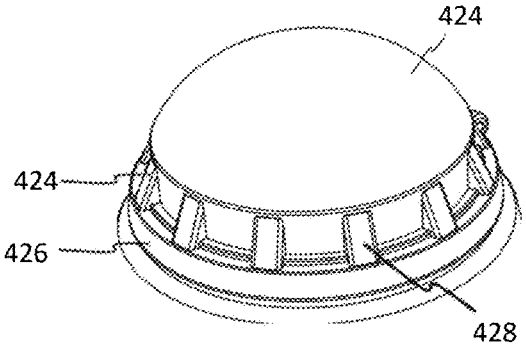
Figure 4F:
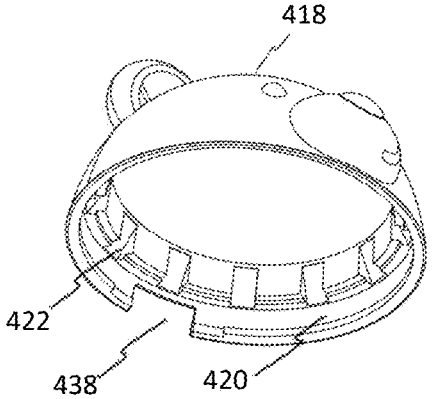
Figure 4H:
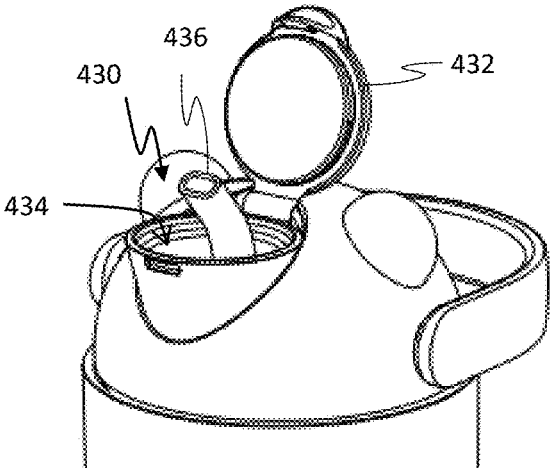
Figure 5A:
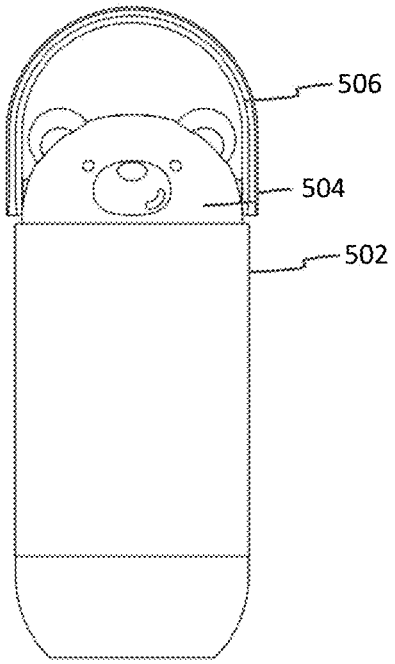
Figure 5B:
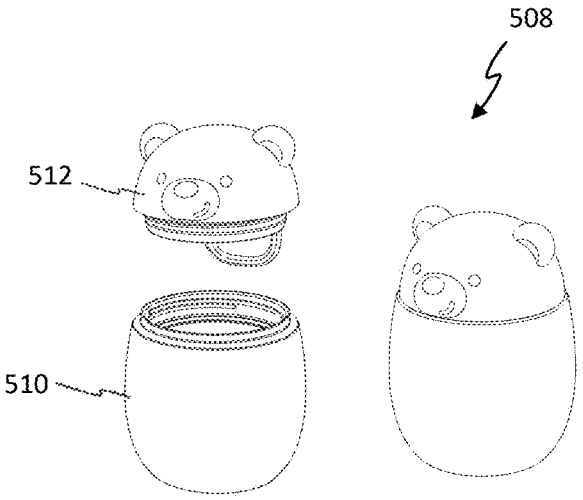
Figure 5C:
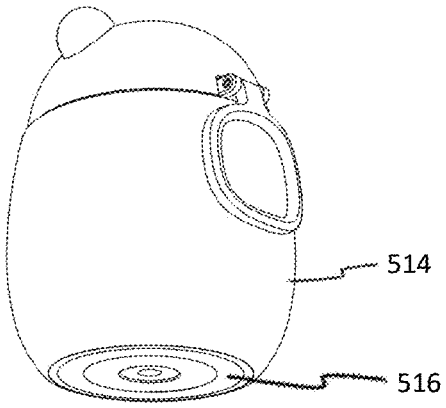
Figure 6A:
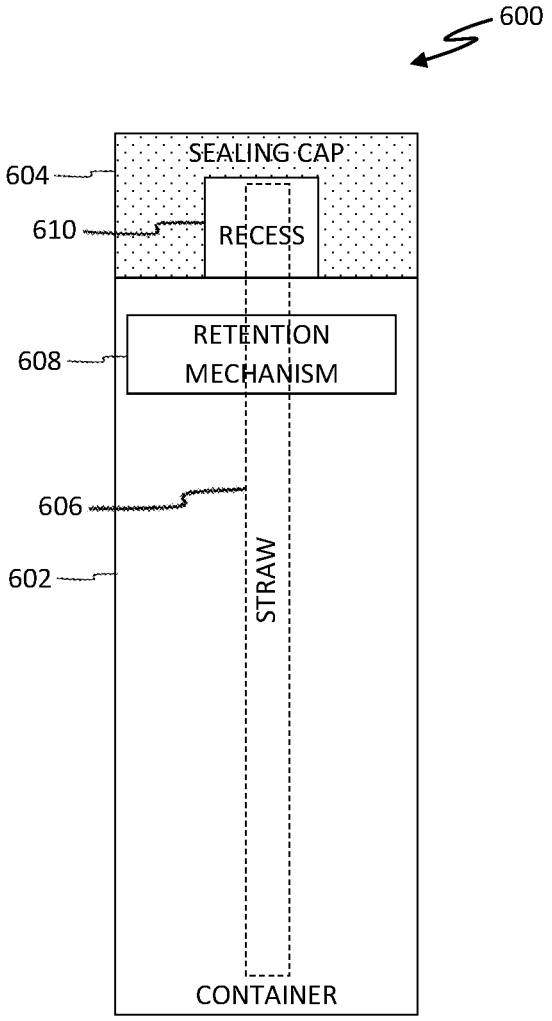
Figure 6B:
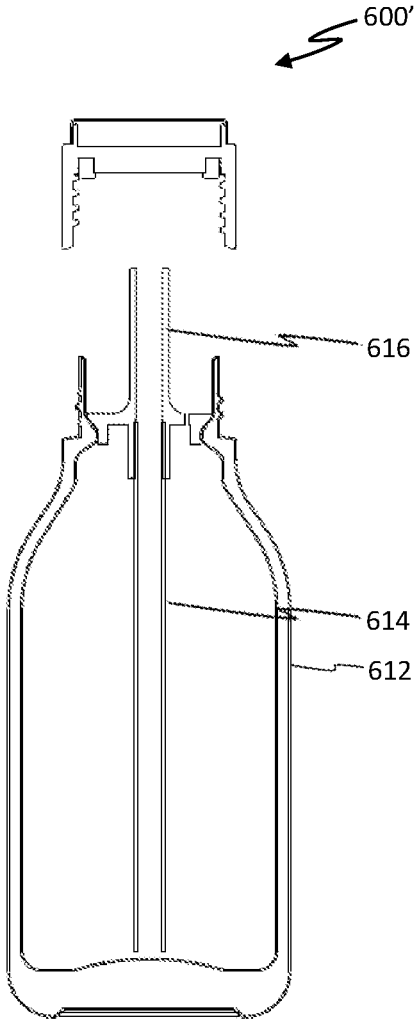
Figure 6C:
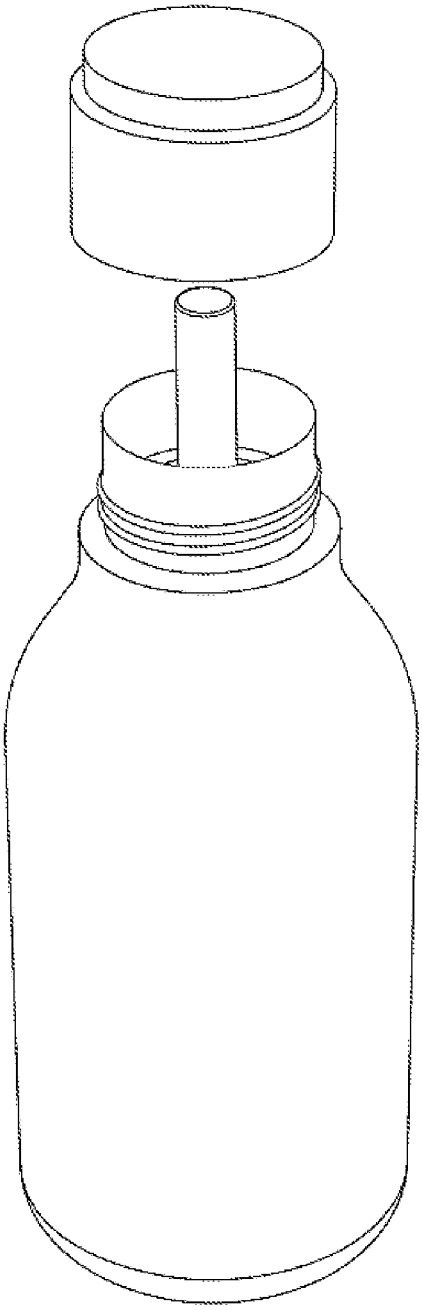
Figure 6D:
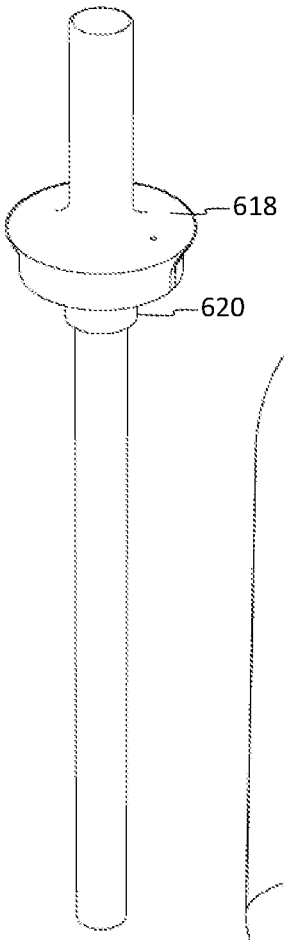
Figure 6E:
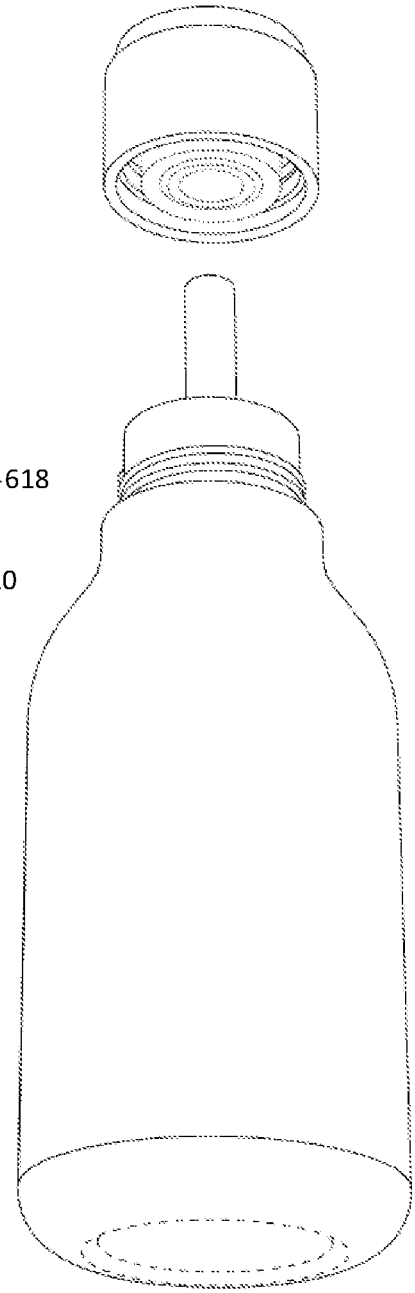
Figure 7A:
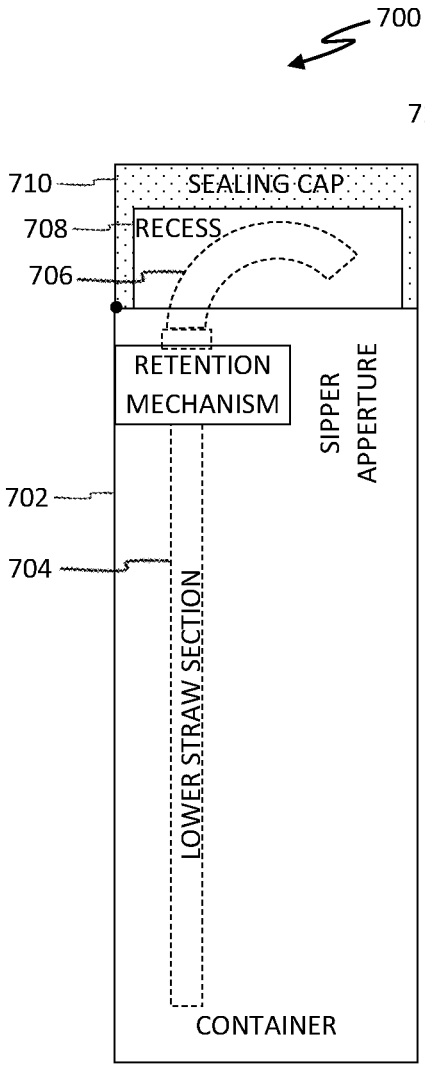
Figure 7B:
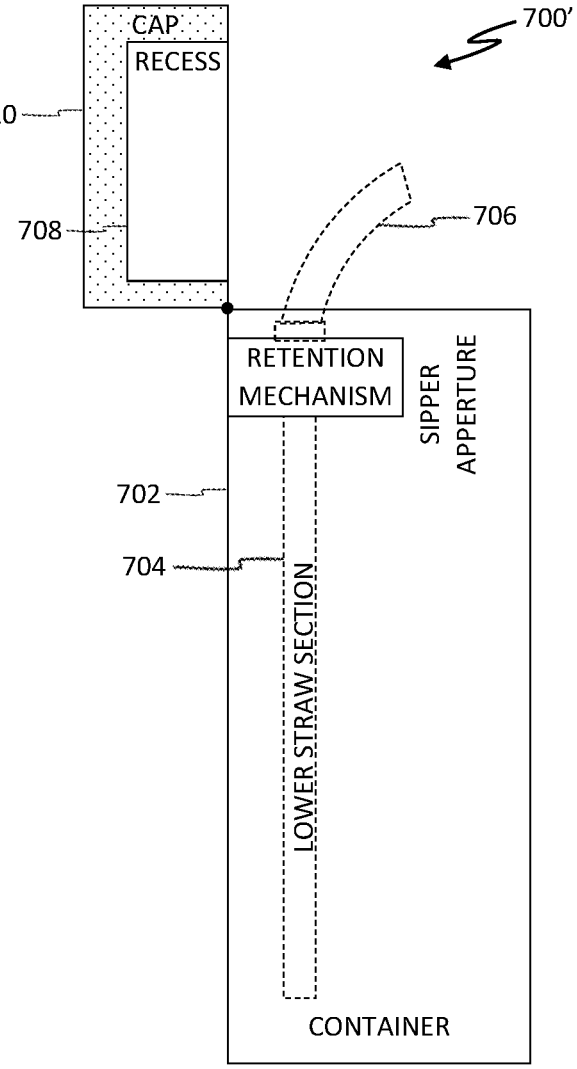
Figure 7C:
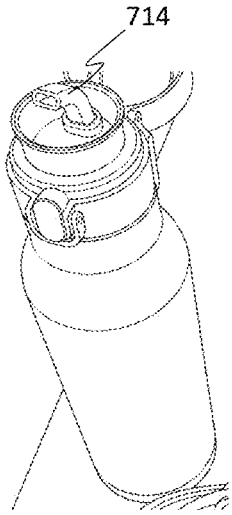
Figure 7D:
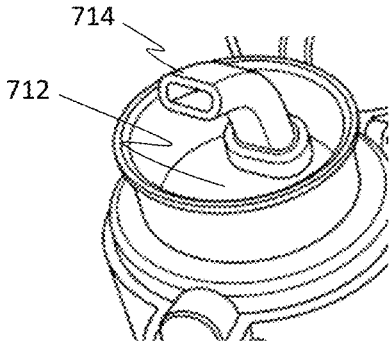
Figure 7E:
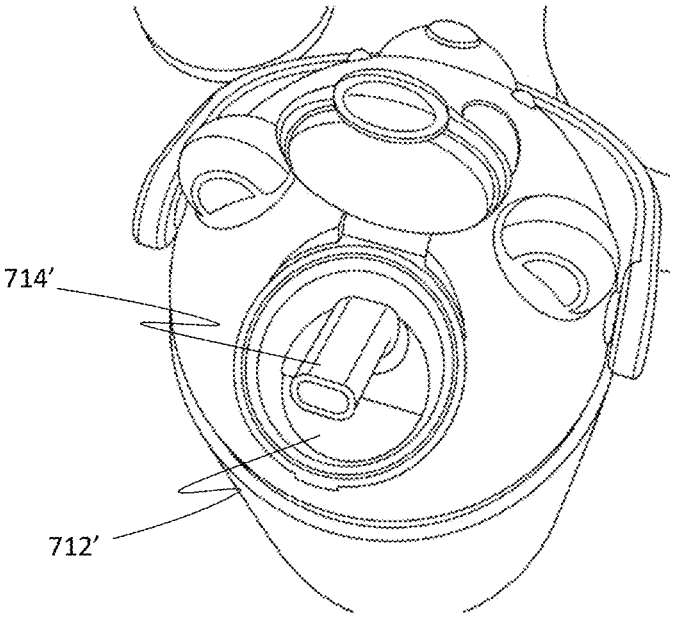
Figure 8A:
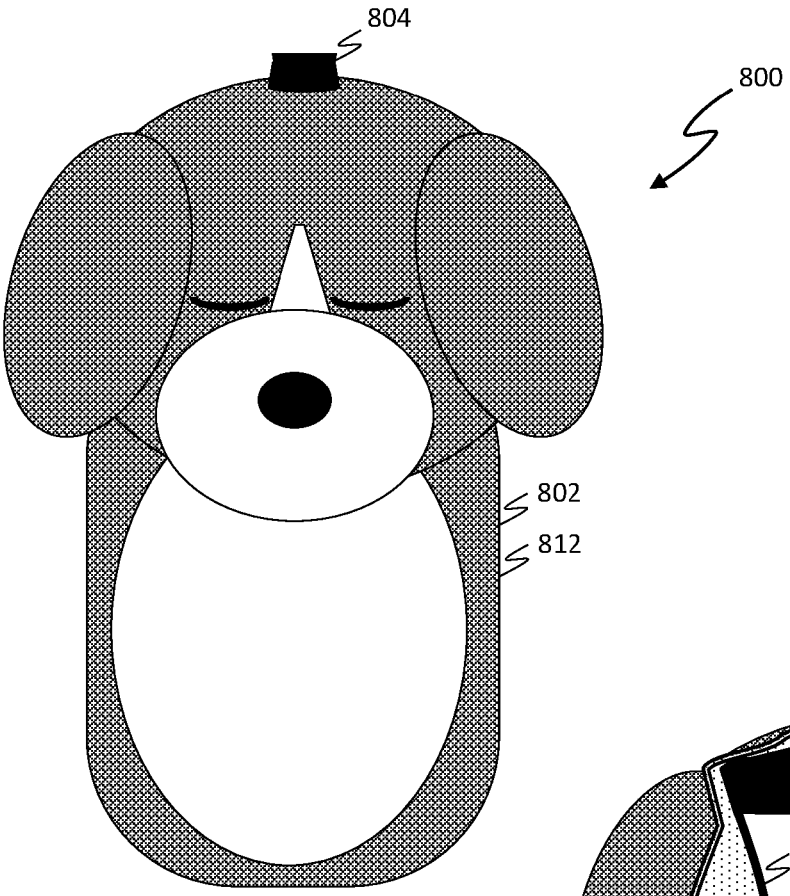
Figure 8B:
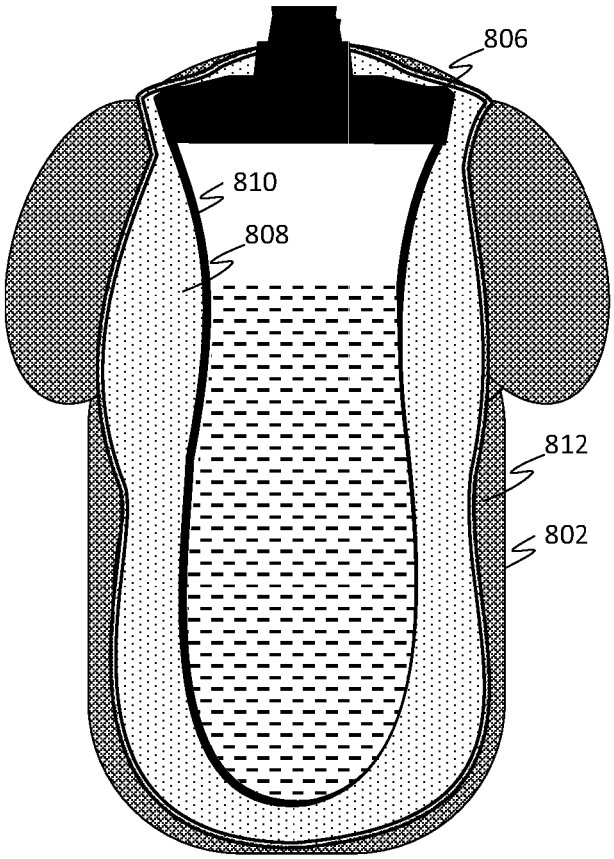
Figure 9A:
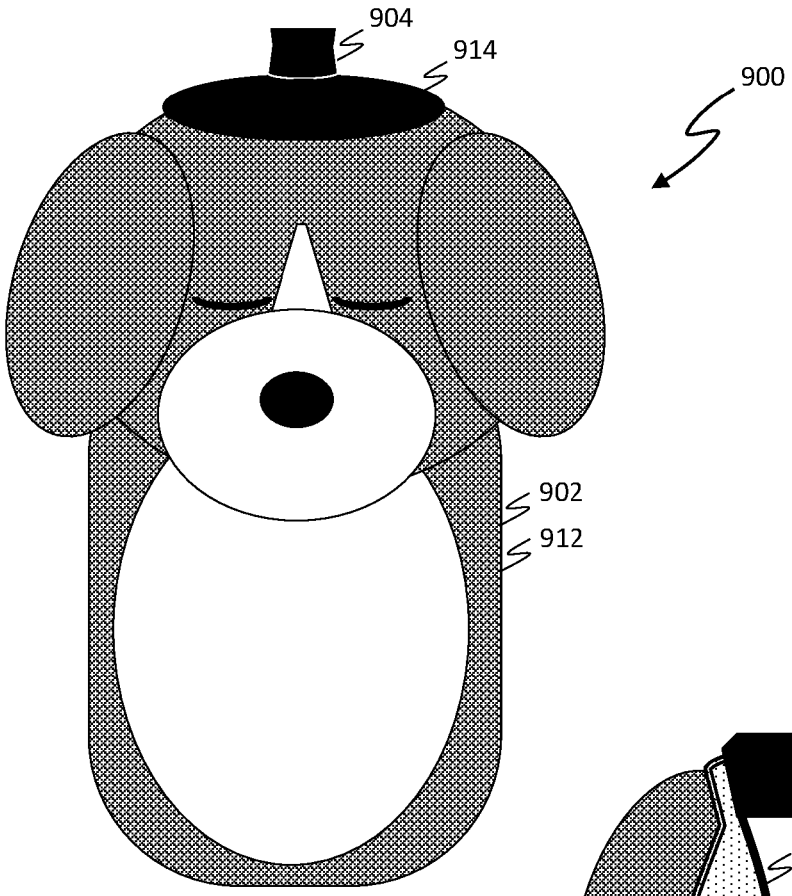
Figure 9B:
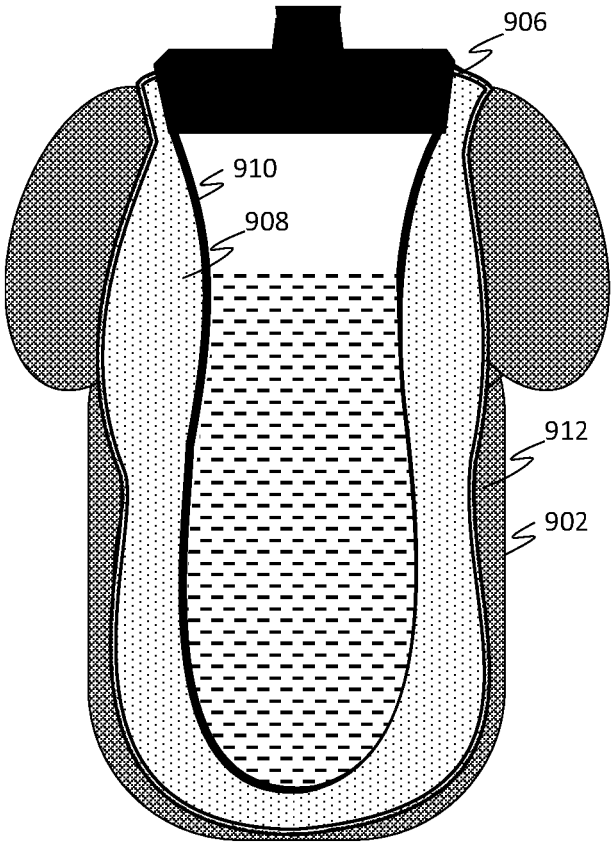
Figure 10A:
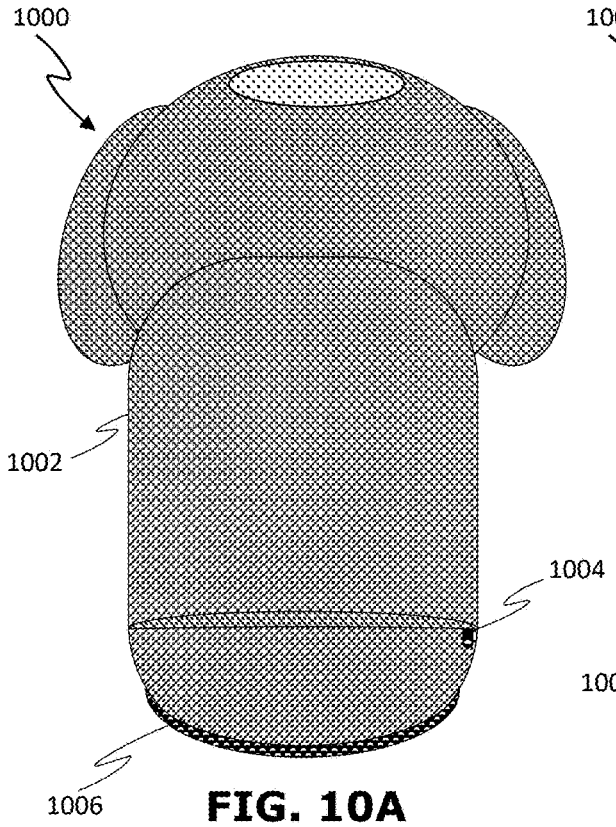
Figure 10B:
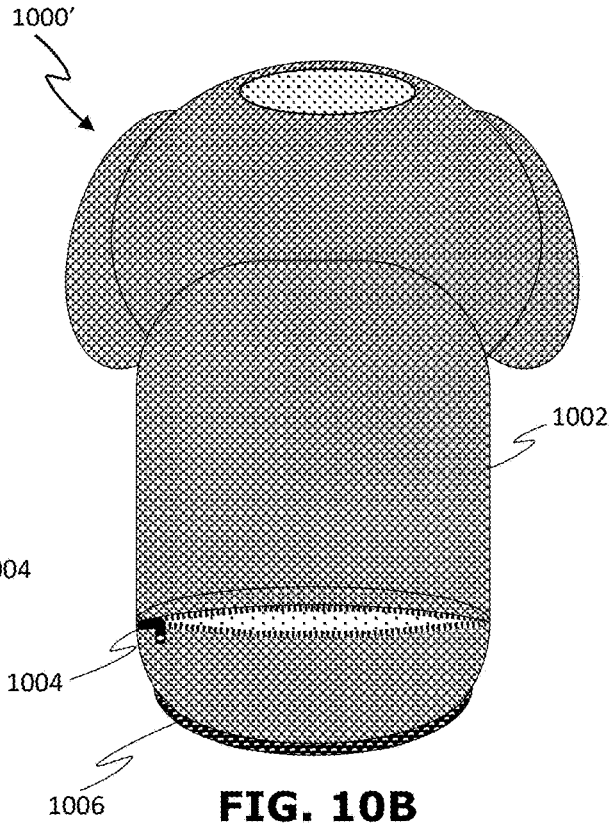
Figure 10C:
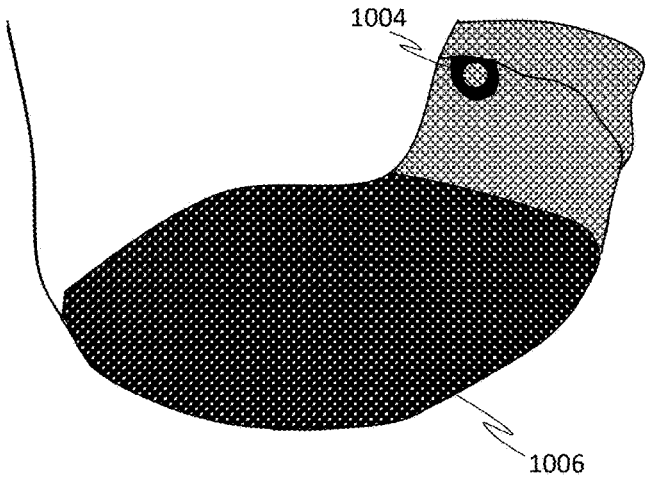
Figure 11A:
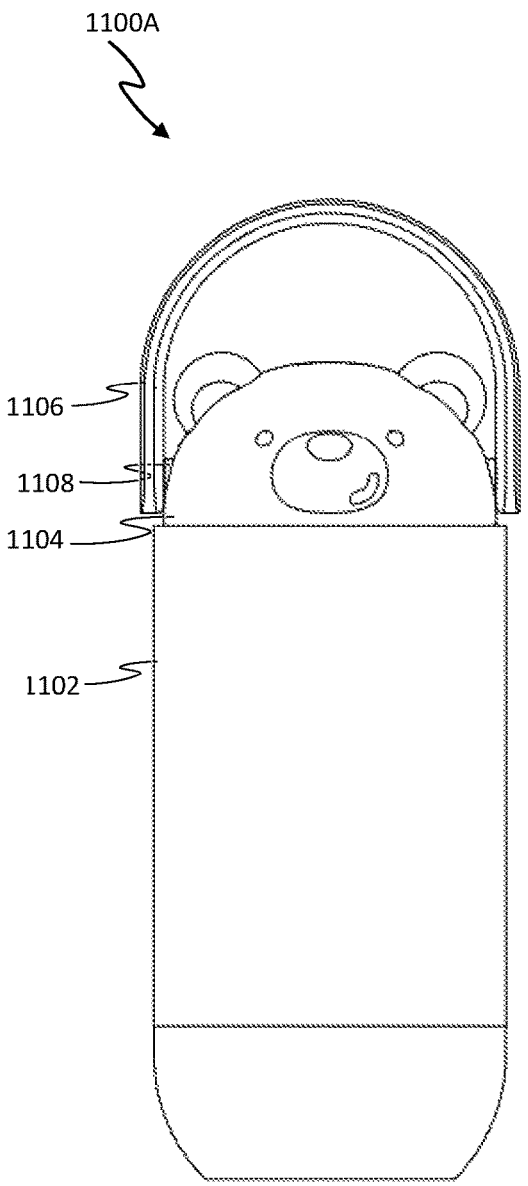
Figure 11B:
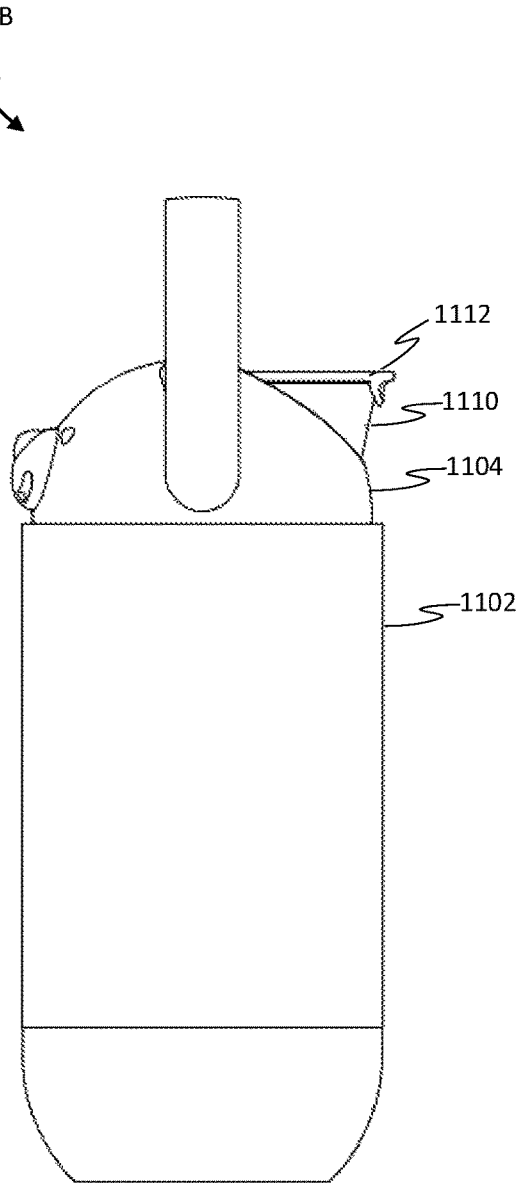
Figure 11C:
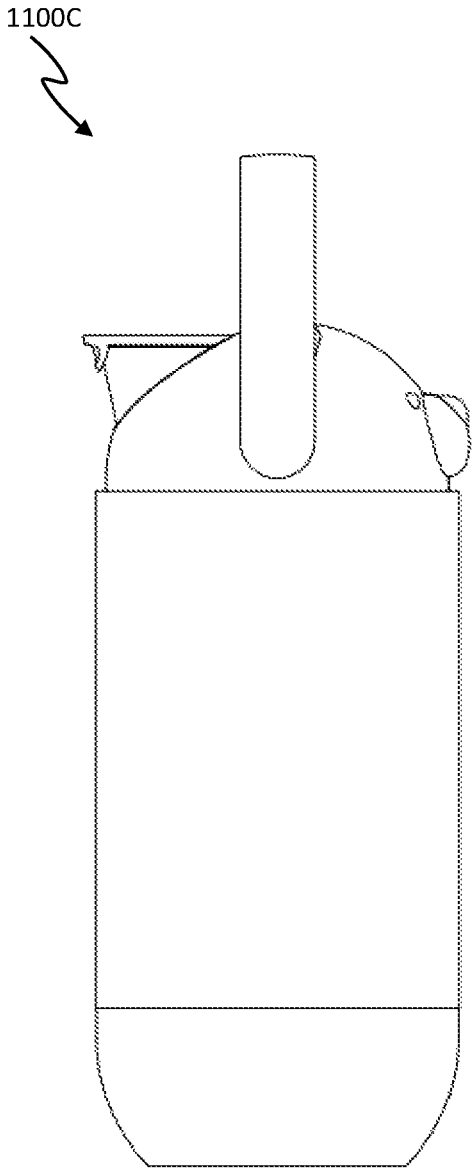
Figure 11D:
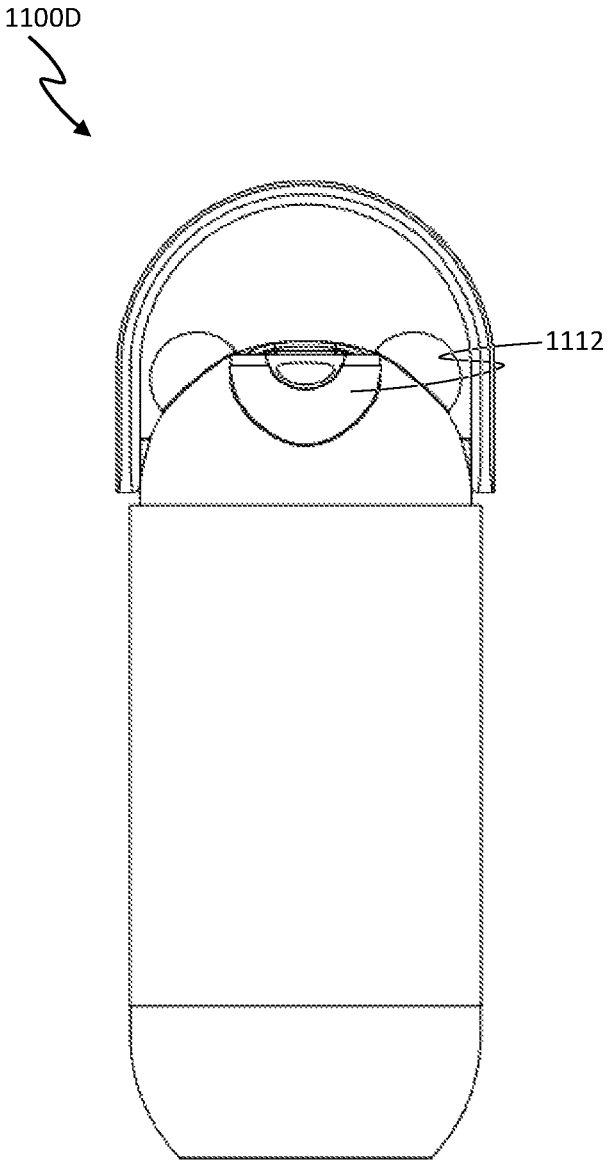
Figure 11E:
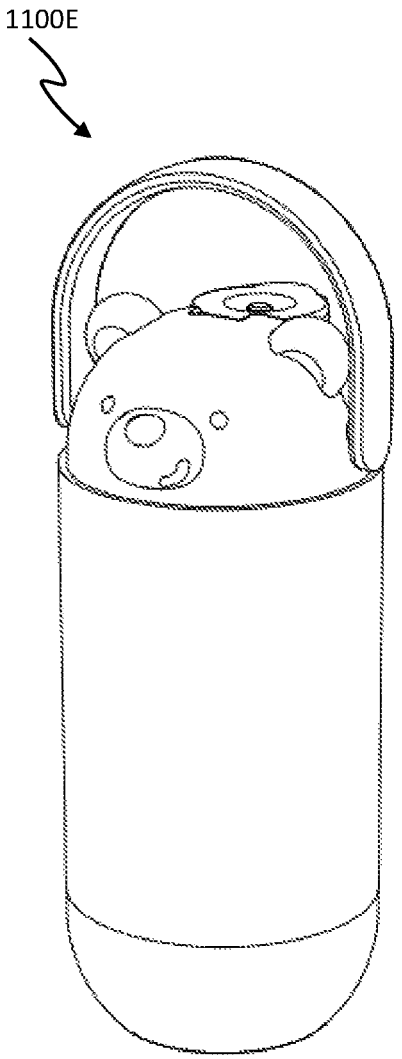
Figure 11F:
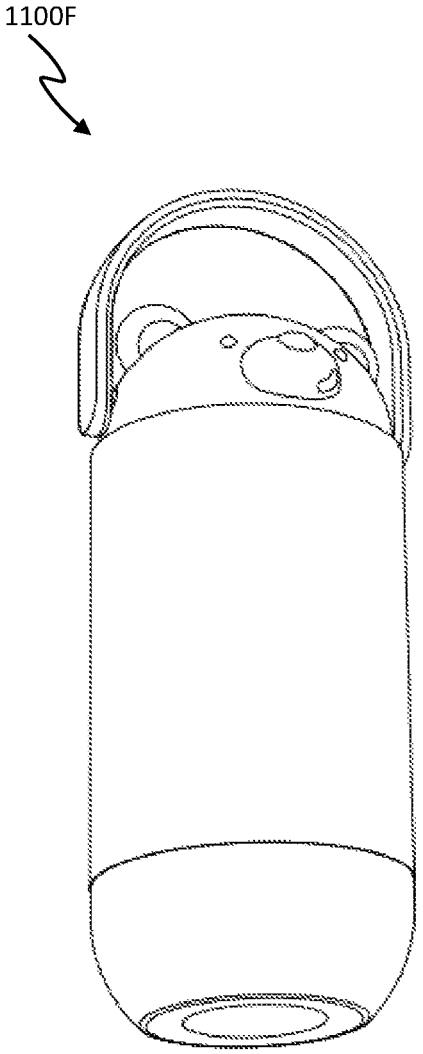
Figure 11G:
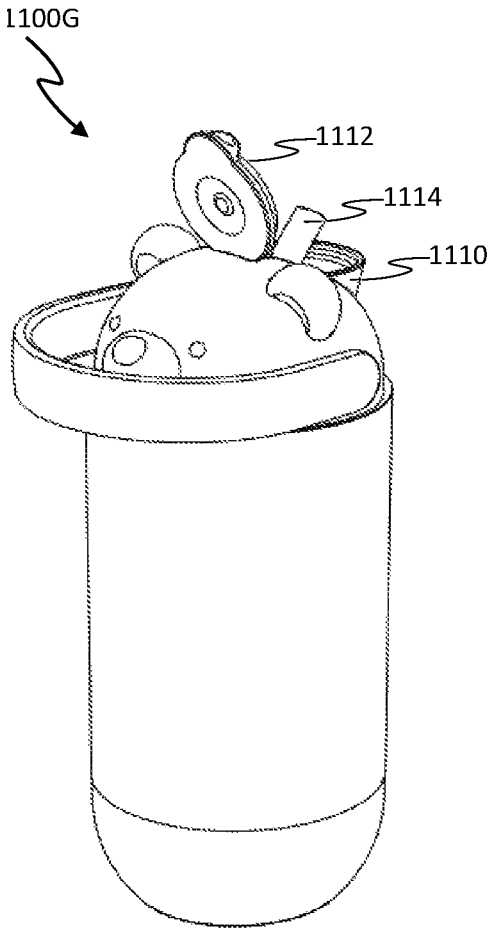
Figure 11H:
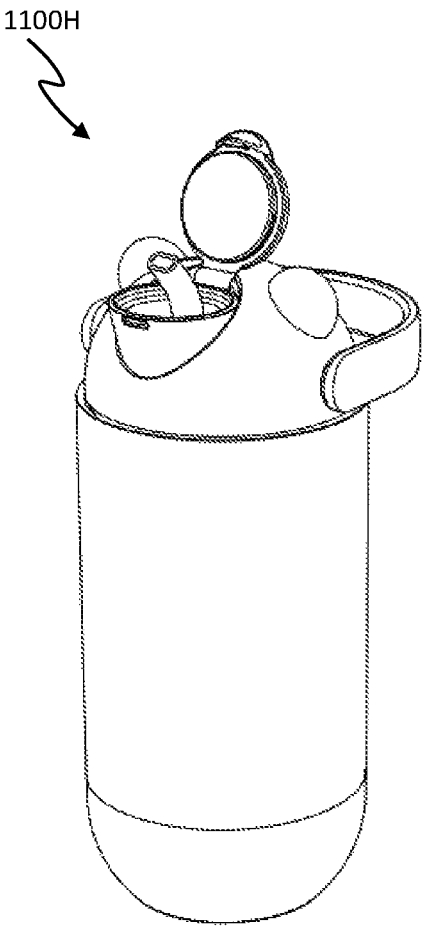
Figure 11I:
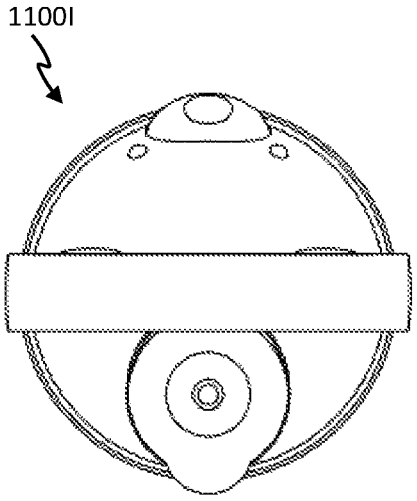
Figure 11J:
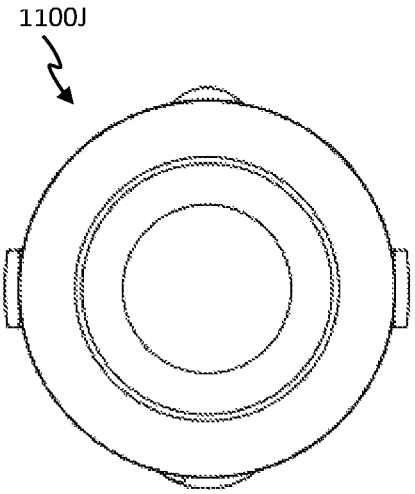
Figure 12:
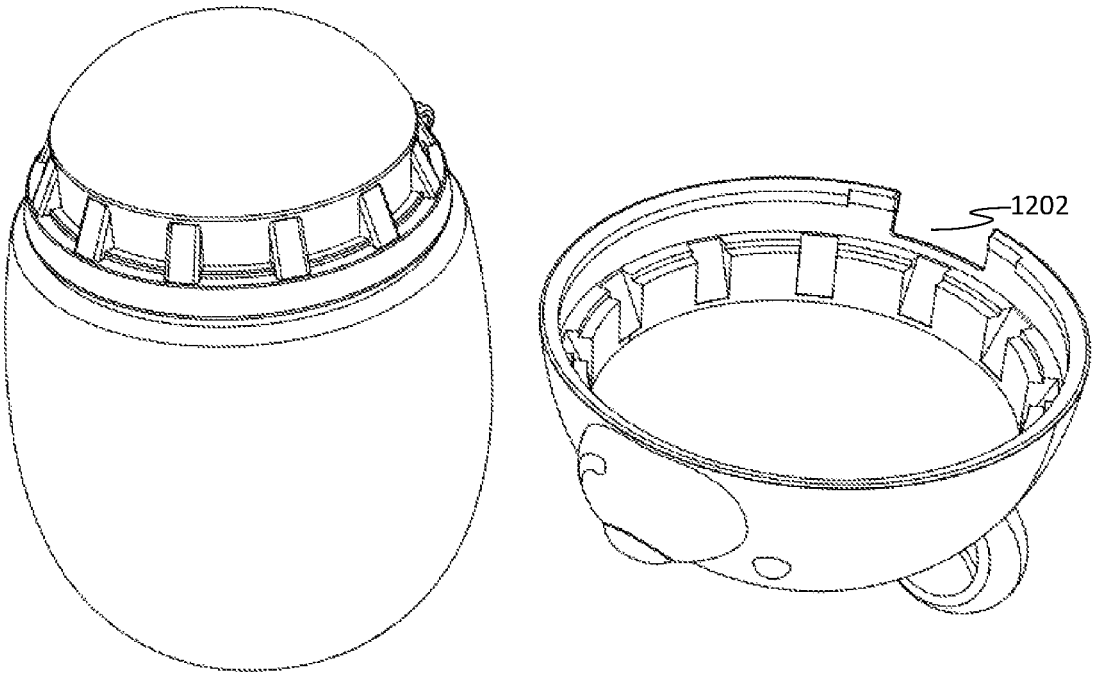
Figure 14A:
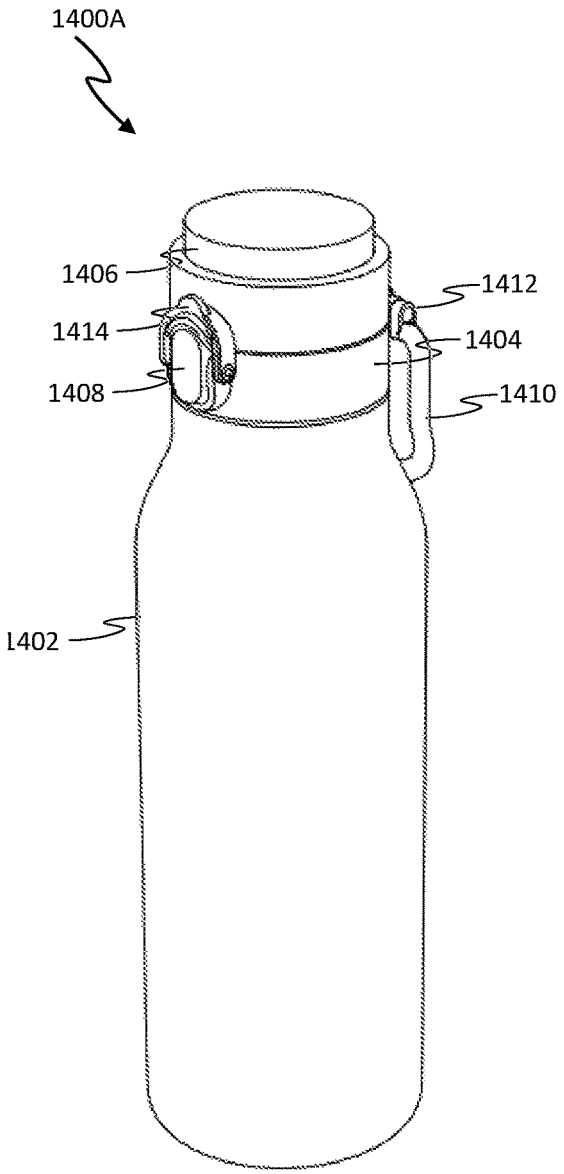
Figure 14B:
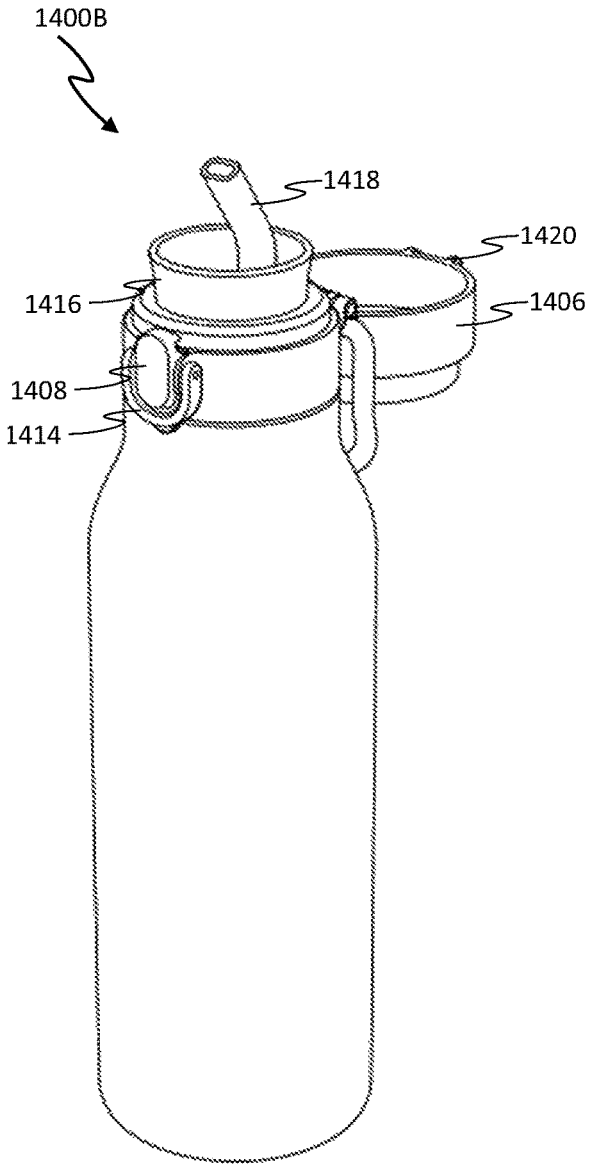
Figure 14C:
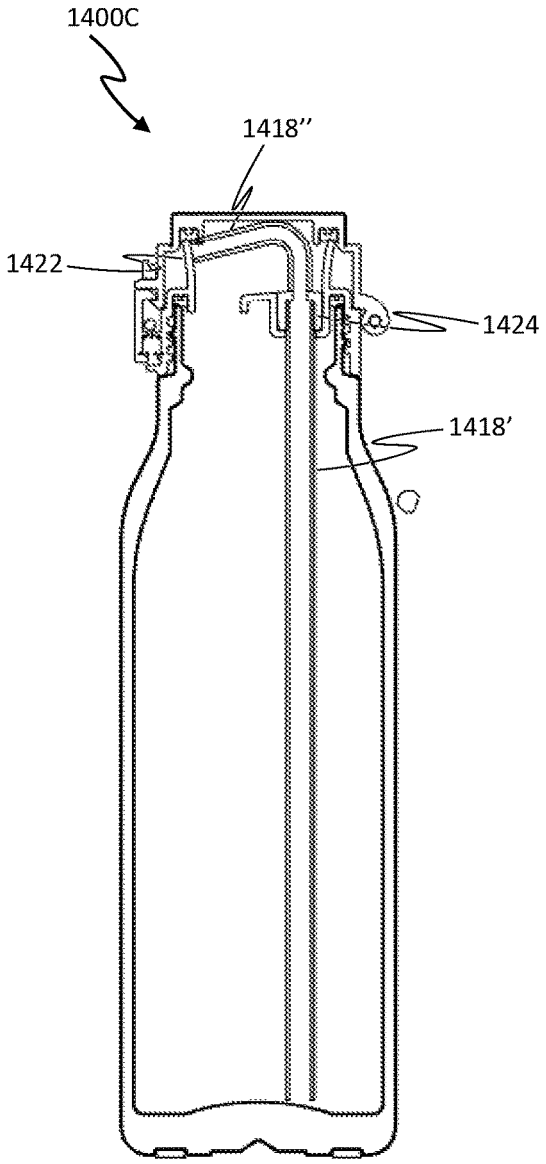
Figure 14D:
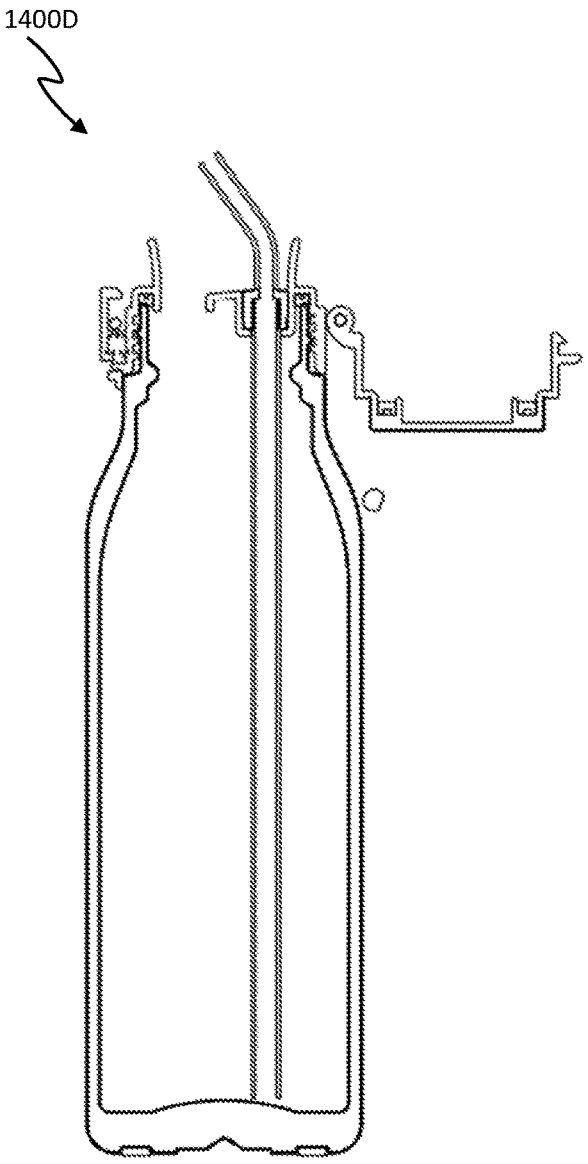

FIGS. 3B-F are schematic representations indicating various exchangeable head caps according to the third embodiment of the current invention;

FIG. 4A is a schematic representation of a system for attaching an exchangeable detachable head to beverage container via a sealing cap according to a fourth embodiment of the current invention;

FIG. 4B is an isometric view of a further example of a beverage container according to a fifth embodiment of the current invention;

FIG. 4C is a front view of a further example of a beverage container according to the fifth embodiment of the current invention;

FIG. 4D is an exploded front view of a further example of a beverage container according to the fifth embodiment of the current invention;

FIGS. 4E and 4F are representations of another embodiment of a detachable head section of a beverage container in the shape of a bear head;

FIG. 4G is an illustration of a sealing cap corresponding to the detachable head of FIGS. 4E and 4F;

FIG. 4H is an illustration of an example of the sealing cap showing an opened access flap revealing a drinking aperture through the sealing cap via which the beverage stored within may be accessed;

FIG. 5A is a schematic representation of a beverage container according to another embodiment of the current invention;

FIG. 5B is a schematic representation of a sealable food container according to another embodiment of the current invention;

FIG. 5C shows the underside of a sealable food container indicating a stabilization element;

FIG. 6A is a schematic diagram representing various elements of a container system incorporating a drinking straw according to another embodiment;

FIG. 6B is a cross section representation through a container system incorporating a drinking straw;

FIG. 6C is an perspective top view of an open container system incorporating a drinking straw;

FIG. 6D shows a straw configured for use in the container system;

FIG. 6E is a perspective top view of the open container system incorporating the drinking straw;

FIGS. 7A and 7B represent closed and open configuration of a further embodiment of the container system having a retracting straw;

FIGS. 7C-E are further representations illustrating examples of the retracting straw;

FIG. 8A is a schematic representation of a possible soft toy type hydration system for incentivizing children to hydrate;

FIG. 8B is a schematic cut-away representation of the soft toy type hydration system cut away to reveal the inner layers;

FIG. 9A is a schematic representation of an alternative possible soft toy type hydration system for incentivizing children to hydrate;

FIG. 9B is a schematic cut-away representation of the alternative soft toy type hydration system cut away to reveal the inner layers;

FIG. 10A schematically represents a rear view of the outer skin alternative soft toy type hydration system in the closed configuration;

FIG. 10B schematically represents the rear side of the outer skin alternative soft toy type hydration system in the closed configuration;

FIG. 10C shows the weighted base section of the alternative soft toy type hydration system;

FIGS. 11A-11F illustrate schematic views of a container system comprising a carrying handle with the access flap in its closed configuration according to an embodiment of the invention;

FIGS. 11G and 11H illustrate schematic views of the container system of FIGS. 11A-11F with the access flap in its open configuration;

FIGS. 11I and 11J illustrate the top and bottom views of the container system, respectively FIGS. 11A-11F;

FIG. 12 represents another embodiment of a beverage container comprising a sealing cap and a detachable head section in the shape of a bear head;

FIGS. 13A-13G illustrate various views of the container system comprising an attached hanger for easy carrying of the container system;

FIGS. 14A and 14B illustrate a closed and an open configuration, respectively of a beverage container comprising a metro flip access flap; and FIGS. 14C and 14D illustrate schematic cut-away representations of the beverage container of FIGS. 14A and 14B in a closed and an open configuration, respectively.

DETAILED DESCRIPTION

Aspects of the present disclosure relate to systems and methods for sealing containers and more specifically to attachment of exchangeable sealing caps to fluid containers.

The systems may include coupling mechanisms for mechanically connecting detachable head caps to the containers and further to seal fluids therewithin. The coupling mechanism may include a head coupler of the beverage container configured to engage directly with a bottle coupler of the head cap.

Additionally or alternatively the head cap may include a detachable head section and a separable sealing cap. Accordingly, the coupling mechanism may include a cap coupler of the beverage container configured to engage with a bottle coupler of the sealing cap. A separate attachment mechanism may be provided for attaching the detachable head to the sealing cap. The attachment mechanism may include a cap coupler of the detachable head configured to couple with a head couple of the sealing cap.

As required, detailed embodiments of the present invention are disclosed herein; however, it is to be understood that the disclosed embodiments are merely examples of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is particularly noted that the systems and methods of the disclosure herein may not be limited in its application to the details of construction and the arrangement of the components or methods set forth in the description or illustrated in the drawings and examples. The systems and methods of the disclosure may be capable of other embodiments, or of being practiced and carried out in various ways and technologies.

Alternative methods and materials similar or equivalent to those described herein may be used in the practice or testing of embodiments of the disclosure. Nevertheless, particular methods and materials described herein for illustrative purposes only. The materials, methods, and examples not intended to be necessarily limiting. Accordingly, various embodiments may omit, substitute, or add various procedures or components as appropriate. For instance, the methods may be performed in an order different from described, and that various steps may be added, omitted or combined. In addition, aspects and components described with respect to certain embodiments may be combined in various other embodiments.

Reference is now made to the block diagrams of FIG. 1A, FIG. 1B and FIG. 1C which represent selected elements of a system 100 for attaching a head cap to a beverage container according to a first embodiment of the current invention. The system 100 includes a head cap 104, a beverage container 102 and a coupling mechanism 106.

The beverage container 102 is configured to contain fluids therewithin. Various beverage containers may include bottles, cups, sipper cups, mugs, thermally insulated food containers and the like. Optionally, the container may be constructed from a material such as stainless steel, plastic, glass, ceramic or combinations thereof.

Where appropriate, the beverage container 102 may include an insulation layer between an inner layer and an outer layer. The inner layer and the outer layer may be made of stainless steel, and may be made of the same grade of stainless steel. Alternately, the inner layer may be made of an 18/8 stainless steel while the outer layer may be made of an 18/0 stainless steel. One skilled in the art would know that 18/8 stainless steel represents a specific grade of stainless having a specific chemical composition containing 18% chromium (Cr) and 8% nickel (Ni). 18/8 steel is one of the most widely used material owing to its excellent corrosion resistance in mild environments, and has good weldability and mechanical properties. Similarly, 18/0 means the steel consists of 18% of chromium and 0% of nickel.

Still other materials may be used for the container as occur to those skilled in the art. In particular, it is noted that where appropriate the container may be coated with a ceramic layer such as described in the applicants copending U.S. patent application Ser. No. 17/947,126 the contents of which are incorporated herein by reference.

The head cap 104 may couple with the beverage container 102 to form a system having an attractive design which may incentivize children to hydrate more effectively. Accordingly, a coupling mechanism 106 may be provided configured to connect a decorative head cap 104 directly to the beverage container 102.

The coupling mechanism 106 may include a bottle coupler part 108 integral to the head cap 104. The bottle coupler part 108 is configured to engage a corresponding head coupler part 110 integral to the beverage container 102.

Various bottle coupler and head coupler mechanisms may be used with the system, for example the bottle coupler 108 may include a screw thread around the inner surface of a circular aperture configured to engage a corresponding screw thread on the outer surface of a circular opening of the beverage container 102 and configured to couple therewith such that when tightly coupled the coupling mechanism forms a water-tight seal and liquids within the container are retained therewithin.

According to other embodiments, male and female push connectors may be preferred for the coupling mechanism. Still other embodiments may include other coupling mechanisms such as clips, studs, fasteners, magnetic pins, vacuum seals, hook-and-eye connectors, high friction surfaces and the like as well as combinations thereof.

It is particularly noted that the head coupler 110 may be a male connector and the bottle coupler 108 may be a female connector. Alternative the head couplers 110 and bottle couplers 108 may be non-binary connectors. Where appropriate the bottle couplers 108 are configured such that they exclusively couple with corresponding head couplers 110 alone. Similarly, the head couplers 110 are configured such that they exclusively couple with corresponding bottle couplers 108 alone. Accordingly, only suitable closures may be used with the fluid container.

Referring now to the block diagrams of FIGS. 2A-E which represent selected elements of a second embodiment of a system 200 for attaching an exchangeable head cap to a beverage container according to a second embodiment of the current invention. It is noted that the function of the head cap 104 of first embodiment is performed in the second embodiment by two separate elements, the detachable head 204 and the sealing cap 208.

The detachable head 204 and the sealing cap 208 are connected by an attachment mechanism 206 made up from a cap coupler 212 integral to the detachable head 204 and a head coupler 214 integral to the sealing cap 208. According to other embodiments, the attachment mechanism may include male and female push connectors, clips, studs, fasteners, magnetic pins, vacuum seals, hook-and-eye connectors, high friction surfaces and the like as well as combinations thereof.

The detachable head 204 may be formed from a soft flexible material such as polymer, rubber, silicone, and/or combinations thereof. In particular, a lead-free and/or food-safe material may be selected for use safely on a food container, such as a drinking bottle. It is further noted that some flexible materials made of plastic, rubber, silicone or the like have unpleasant or unattractive odors, accordingly it is a feature of certain embodiments of the current connecting caps for containers that the selected material of the detachable head is an odorless plastic, rubber, silicone or such like material. Alternatively a pleasant odor may be added to the material to overpower or mask an unpleasant odor.

The material of the detachable head 204 may be further selected for mechanical properties, for example such that it has a high coefficient of friction with the material of the sealing cap 208 such that the attachment mechanism 206 is formed by an inner surface of the detachable head 204 configured to grip the outer surface of the head coupler 214 such that the sealing cap 208 or container 202 may be connected securely. Where required a gripping ring may be provided for tightening the grip between the inner surface of the detachable head 204 configured to grip the outer surface of the head coupler 214.

The container 204 is sealable by a watertight closure formed between the cap coupler 218 of the beverage container 202 and the corresponding bottle coupler 216 of the sealing cap 208.

Where appropriate, the detachable head 204 may couple with the sealing cap 208 such that when connected to the beverage container 202 the whole forms a system having an attractive design which may incentivize children or adults to hydrate more effectively and frequently. Such attractive designs may be attractive because of their look, feel, smell or function. For example, the aesthetic form of the detachable head may resemble a doll, model, comfort toy or the like such as illustrated in the figures. Other attractive features may be a soft material of the head 204 which is pleasant to the touch. In certain embodiments, the container 202 may be rubberized such that a matching soft material skin is provided around the body of the container 202 itself. Accordingly, the container 202 and head 204 may function as a doll or other such comfort toy in its own right.

Attractive features may further include affiliative symbols such as crosses, crescents, stars, or other religious symbols, sports team icons, national symbols or the like. The symbols may also be according to the interest or hobby of the person. Alternatively, the attractive feature may include the images of the living beings or non-living objects.

Still other attractive features may include a pleasantly smell, for example a head shaped like a piece of fruit may also smell like that fruit. A strawberry shaped head may smell of strawberry, an orange shaped head may smell of orange or such like. Indeed, the feature of scented heads has function beyond its attractiveness as a range of scented heads may be provided for a single bottle such that the odor of the cap may be used to indicate the contents of the container.

It is particularly noted that the detachable head 204 may include a functional attractive feature such as a toy or a stress relief element. A stress relief element may be a mechanical clicker, a fidget switch, knob, slider, ball or the like incorporated into the head 204. Alternatively, the stress relief element may be the natural give of the soft material from which the head is made.

Still other toys include whistles, bells, music players, cap-guns, catapults, magnifying glasses, spy glasses, puzzles, ball-baring mazes and the like as may occur to those skilled in the art.

Figure 3A:
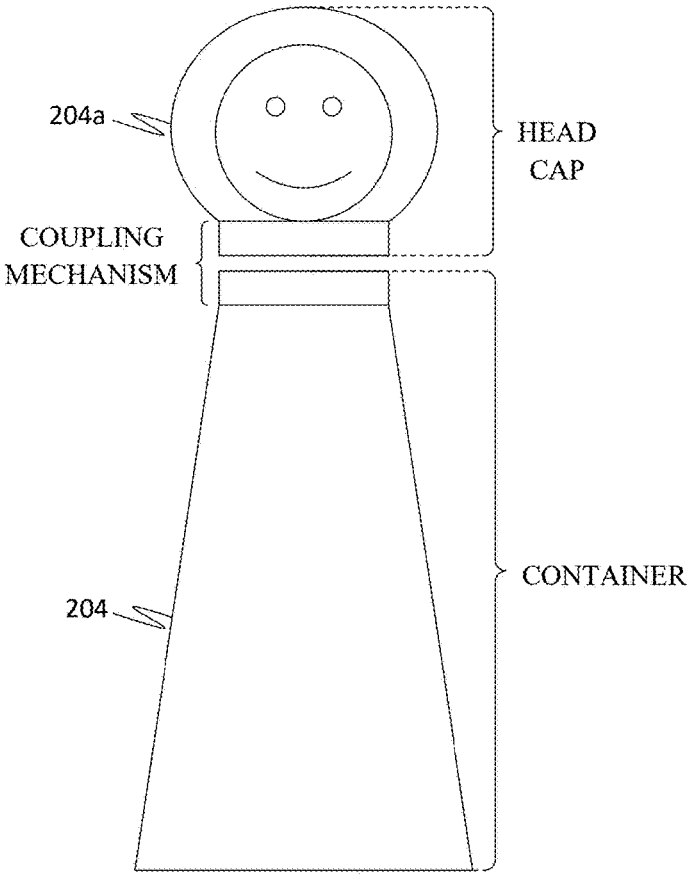
FIG. 3A is a schematic representation of a sealable beverage container according to a third embodiment of the current invention.
Figure 3B:
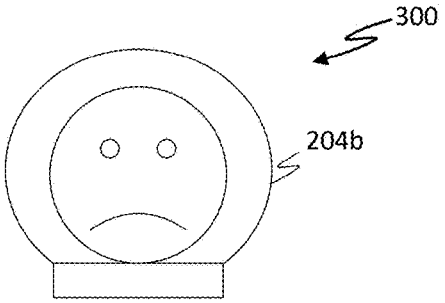
Figure 3C:
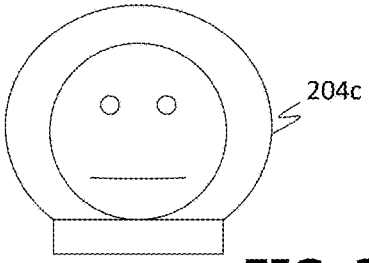
Figure 3D:
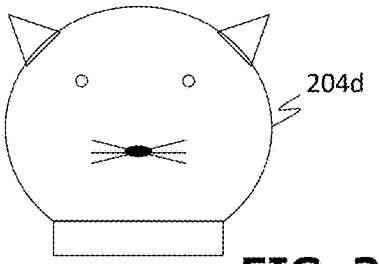
Figure 3E:
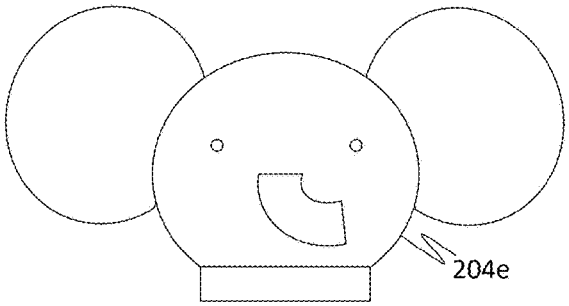
Figure 3F:
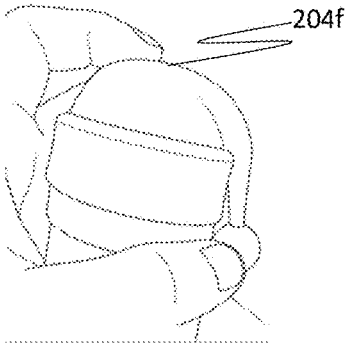

Referring now to FIGS. 3A-E, a system 300 is represented of a sealable container 302 according to a third embodiment of the current invention which has been provided with a selection of interchangeable heads including a smiling face 204*a* as shown in FIG. 3A, a frowning face 204*b* as shown in FIG. 3B, a neutral face 204*c* as shown in FIG. 3C, a stylized cat face 204*d* as shown in FIG. 3D or a stylized elephant 204*e* such as shown in FIG. 3E. It is a feature of the set of heads that they may be interchangeably connected to the same container to form attractive figures which may incentivize children to consume more fluids throughout the day. FIG. 3F shows an example of a particular embodiment of a cap 204*f* with a soft pressable stress relief feature. The cap 204*f* is made of a soft material such as rubber which may be pressed continuously through a finger for some time to get relieved of the stress. The cap 204*f* here may alternatively be made of a soft flexible plastic to provide the stress relief feature. Further, the cap 204*f* may include a spring mechanism inside it to provide the stress relief feature. The spring mechanism compresses on being pressed by the finger and expands on relieving.

Referring to FIG. 4A, where appropriate the detachable head section 406 may be connected to the container 402 via a separate sealing cap 404. The detachable head 406 may be formed from a soft flexible material and may be attachable simply by pushing it onto the sealing cap 404 such as described hereinabove. The sealing cap 404 is attached to the container 404 using any of the mechanism described hereinabove.

Still another embodiment of the current invention is represented in FIG. 4B, FIG. 4C and FIG. 4D which show an isometric view 400 in a closed configuration, a front view 400' in an open configuration and an exploded view 400", respectively of a further example of a container system including a head section in the shape of a rabbit head, a sealing cap and a bottle.

The sealing cap 408 as shown in the exploded view 400" has an inner surface 410 and an outer surface 406. The inner surface 410 of the sealing cap 408 incorporates a bottle coupler comprising a screw thread (not shown) configured to couple with a corresponding screw thread 414 of a cap coupler 412 around the neck of the bottle 402.

The head section 404, formed in the decorative shape of a rabbit, has an inner surface incorporating a cap coupler (not shown) configured to couple with the head coupler outer surface 406 of the sealing cap 408. The cap coupler comprises a surface of a material selected for its high coefficient of friction with the outer surface of the head section.

Reference is now made to FIGS. 4E and 4F which illustrate another embodiment of a detachable head section in the shape of a bear. FIG. 4E is a top perspective view of the detachable head section 416 from the front side. FIG. 4F is a bottom perspective view of the detachable head section 418 showing its concave inner surface 420 including the cap coupler mechanism 422 around the inner rim.

FIG. 4G is a top perspective view of a corresponding sealing cap 424 which is configured to engage with the detachable head section. The sealing cap 424 has a head coupler mechanism 428 around its outer rim 426 which is configured to engage the corresponding cap coupler mechanism 422 around the inner rim 420 of the detachable head 418.

In particular, it is noted that the head coupler mechanism 428 of the sealing cap 424 comprises a series of raised protrusions arranged around the outer rim 426 of the sealing cap 424. Similarly, the cap coupler mechanism 422 of the detachable head 418 includes a corresponding series of indentations likewise arranged around the inner rim 420 of the detachable head 418. Accordingly, the attachment mechanism connecting the detachable head section 418 and the sealing cap 424 of the embodiment is formed by placing the head section 418 over the sealing cap 424 such that the protrusions 428 of the sealing cap 424 align with the corresponding indentations 422 of the head section 418 and engage therewith.

It will be appreciated that, thus engaged, the protrusions and indentations of the attachment mechanism may prevent unwanted slippage when the cap 424 is twisted. Indeed while twisting, the leading wall of the protrusions will push against the trailing wall of the corresponding indentation thereby increasing the torque applied to the sealing cap such that the cap is easier to attach to and detach from the container as required.

In various examples of the sealing cap, as illustrated in FIG. 4H, easy access to a beverage stored within the container may be required when the sealing cap is attached to the container. Such access may be provided by incorporating a closable drinking aperture 430 through the sealing cap.

The closable drinking aperture 430 may include an access flap 432, which may be hinged for example via a pin and socket or the like. Additionally or alternatively, the access flap 432 may be completely detachable from the sealing cap. When the access flap 432 is in its closed configuration, typically a water tight seal is formed preventing leakage of liquids through the drinking aperture 430. To this end, sealing elements such as rubber, silicon, plastic washers or the like may be incorporated onto the underside of the access flap 432. When in the open configuration the drinking aperture 430 may be divided into two sections, a sipper aperture 434 and a drinking straw 436 via which the beverage within may be accessed.

FIGS. 5A and 5B illustrate other possible embodiments in which the headed cap may be attached to various containers. In particular, the container 502 of FIG. 5A includes a carrying handle 506 which is rotatably connected around the head cap 504. The carrying handle 506 may be connected via pin joints to the bottle 502 on either side of the head 504. Typically, the screw thread of the sealing cap 504 is configured such that the head points away from the handle 506 (i.e. in a direction orthogonal to the bridge of the strap). Accordingly in some embodiments the removable head may include an orientation element 438, such as shown in FIG. 4F for example, such that when correctly fitted, the orientation element 438 ensures correct alignment of the head in relation to the carrying handle. The orientation element 1202 is also illustrated in another embodiment in FIG. 12. The orientation element 1202 allows proper alignment of the head on the sealing cap to avoid accidental opening and falling of container in case the handle is not properly fitted over the cap.

Still further embodiments of the container are represented in FIG. 5B which shows examples of wide necked food containers 508 with insulated sides 510 and suitable for containing solid or liquid foodstuffs safely. The food containers 508 are characterized by decorative head sections 512 which may serve to seal the containers 508.

Referring to FIG. 5C which shows the underside of an example of an insulated food container 514 having a child friendly form and which has a stabilization element such as a gripping ring 516 around its base which may have a high coefficient of friction with common surfaces. The addition of a stabilization element, gripping ring, disk or the like on the underside of the food container may make the container more stable particularly when used by the young ones.

The container comprising a carrying handle is also illustrated through various views in FIGS. 11A-11K. FIG. 11A shows a front view 1100A of a container system according to an embodiment of the invention. The container system comprises a container 1102, a sealing cap 1104 and a carrying handle 1106. The carrying handle 1106 is connected via pin joints 1108 on either side of the sealing cap 1104. FIGS. 11B and 11C illustrate the side views 1100B and 1100C of the container system. The container system comprises a closable drinking aperture 1110 closed with an access flap 1112 which may be hinged for example via a pin and socket or the like. Additionally or alternatively, the access flap 1112 may be completely detachable from the sealing cap 1104. When the access flap 1112 is in its closed configuration, typically a water tight seal is formed preventing leakage of liquids through the drinking aperture 1110. FIG. 11D shows the rear view 1110D of the container system with the access flap 1112 in its closed configuration. FIGS. 11E and 11F illustrate other schematic views 1100E and 1100F of the container system.

FIGS. 11G and 11H illustrate schematic views 1100E and 1100F of the container system with the access flap 1112 in its open configuration. On opening the access flap 1112, a drinking straw 1114 protrudes out from the aperture 1110 for convenient access by a drinker.

FIGS. 11I and 11J illustrate the top view 11001 and the bottom view 1100J of the container system, respectively.

Figure 13A:
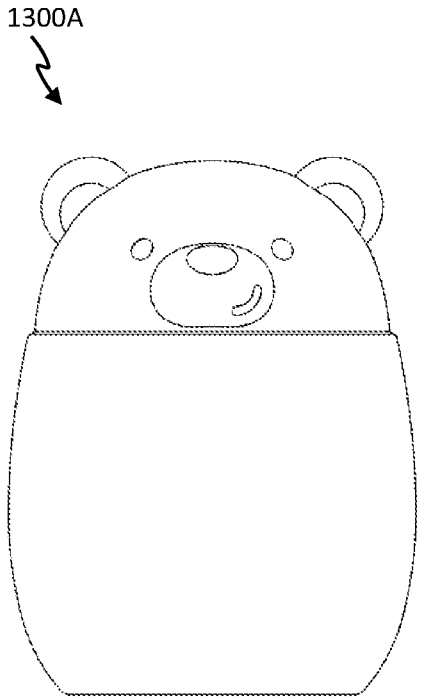
Figure 13B:
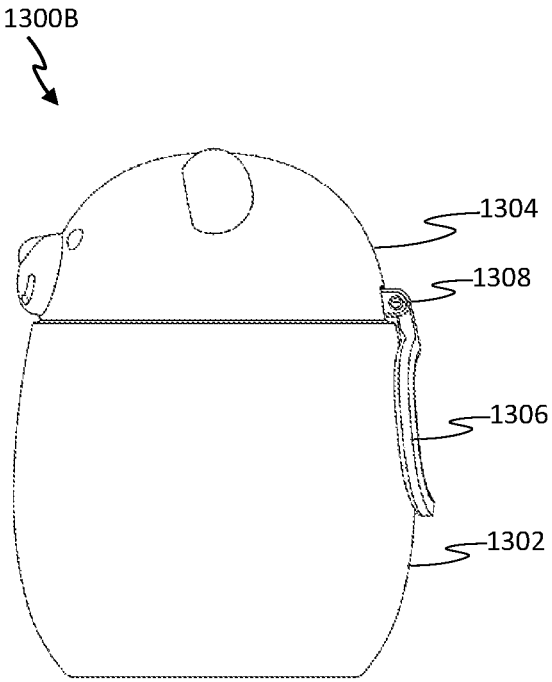
Figure 13C:
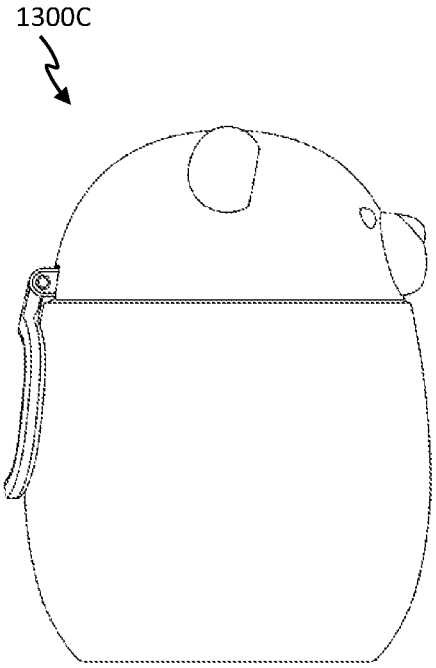
Figure 13D:
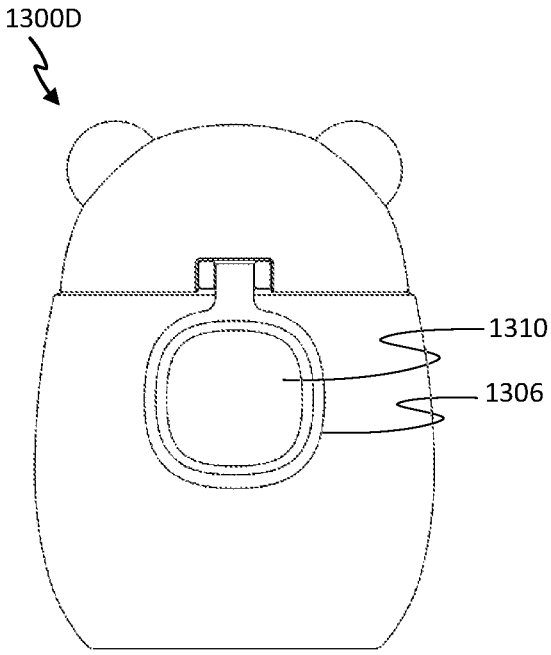
Figure 13E:
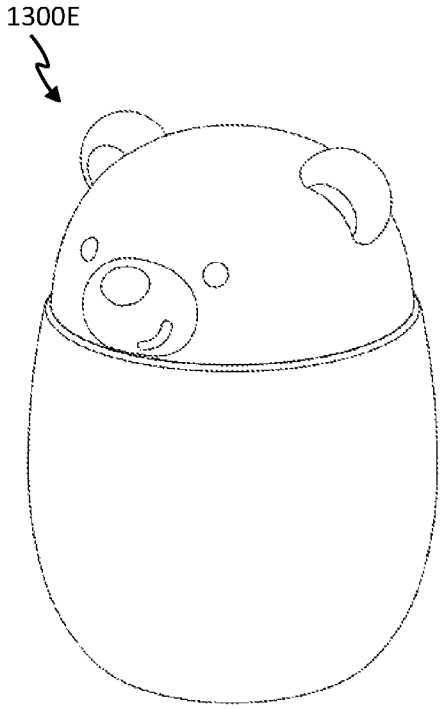
Figure 13F:
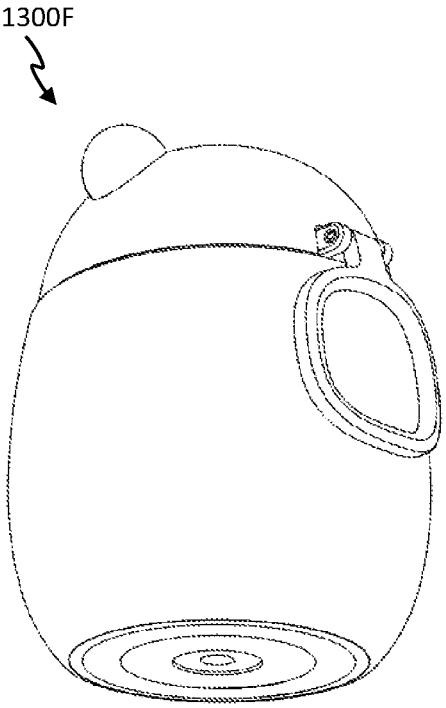
Figure 13G:
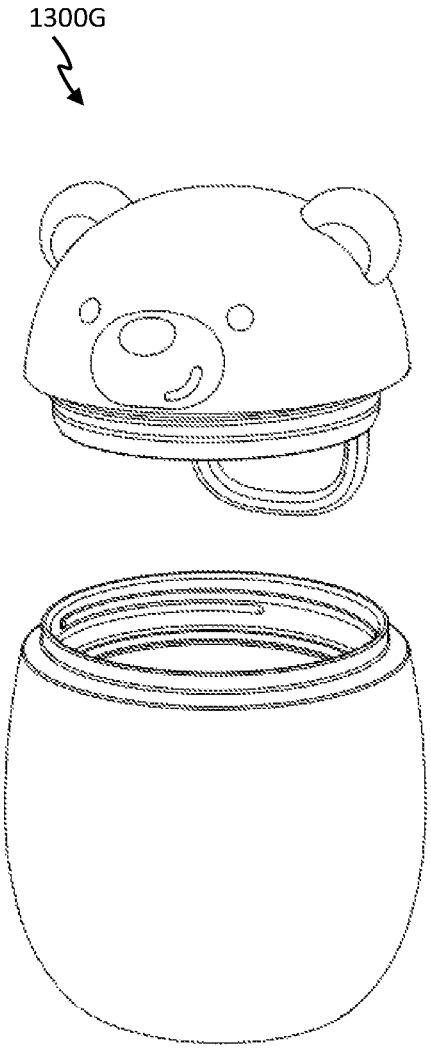

In other embodiments, an attachment element, hook, carabiner, hanger or the like may be provided with which the containers may be readily connected to school bags, back packs or the like. FIGS. 13A-13G illustrate various views of the container system comprising an attached hanger for easy carrying of the container system. The hanger 1306 is attached to the sealing cap 1304 via a hinge 1308 as shown in a side view 1300B of the container. The hanger 1306 may be lifted up for connecting to school bags, bag packs, etc. or carrying in hand. The hanger 1306 may be ring shaped with an opening 1310 in between for attaching to the bag or carrying through the hand as shown in FIG. 13D.

With reference now to FIG. 6A, another embodiment of the container system 600 which has a drinking straw accessible when the container is open but configured to fit within the container system when the system is closed. The system 600 includes a container 602, a sealing cap 604, a straw 606 and a straw retention mechanism 608.

The sealing cap 604 includes a recess 610 therewithin provided to house the protruding section of the drinking straw 606 when the container 602 is sealed with the sealing cap 604. The container system may further include a straw retention mechanism for holding the straw in place within the container.

Referring now to FIGS. 6B-E, which represent various views of an example of the container system which includes the drinking straw. A cross-section view of the container system 600' is represented in FIG. 6B, the straw has a lower section 614 extending into the bottom of the container 612 and an upper section 616 protruding upwards therefrom. The upper section of the straw includes a straw retention mechanism comprising a radial flange disk 618 as shown in FIG. 6D, configured to rest upon an inner ledge around the inside of the neck of the container when the straw is placed in the container from the top side. Optionally, the inner ledge is angled downwards and the flanged disk has a corresponding taper to a side wall around the circumference of the straw retention mechanism such that it is secured snuggly into place by its own weight.

The underside of the straw retention mechanism includes a downward protruding section 620 comprising a cylindrical tube extending into the container and having an inner radius selected such that its inner surface can couple with a lower section extension of the straw.

As indicated in FIG. 6D and in the cross section of FIG. 6B, a further feature of the straw retention mechanism includes an air aperture configured to equalize air pressure inside and outside the container such that the internal pressure in the space above fluid contained with the bottle is the same as the ambient pressure outside. It is noted that the air aperture enables the straw to function when its internal air pressure is reduced thereby creating a negative pressure differential forcing liquid upwards.

With reference now to FIGS. 7A and 7B, a further embodiment of the container system is shown in the closed configuration 700 and open configuration 700'. The embodiment of FIGS. 7A and 7B is characterized by a drinking straw 704 with a flexible upper section 706 configured to fold into a recess 708 within the container 702 when the sealing cap 710 is closed as represented in FIG. 7A. In the open configuration 700', the elasticity of the upper section 706 of the straw 704 causes the end of the straw to spring up such that it protrudes from the container 702 for convenient access by a drinker.

The embodiment includes a container 702, a sealing cap 710, an upper straw section 706, a lower straw section 704 and a straw retention mechanism 708. Optionally, the drinking aperture may also be divided into two sections, a sipper aperture 712,712' allowing direct access to beverages within as well as the drinking straw mechanism 714, 714' as shown in FIGS. 7D and 7E.

The sealing cap may include a recess 708 into which the flexible upper section of the drinking straw 706 may be folded when in the closed configuration. Additionally or alternatively, the upper section of the drinking straw 706 may fold away into the upper section of the container when the sealing cap is closed.

Optionally, the straw may include a lower section extending into the bottom of the container and an upper section protruding upwards therefrom. The upper section of the straw may have a plug at one end configured to fit snuggly into a socket within the retention mechanism and so to couple therewith.

The underside of the straw retention mechanism includes a downward protruding section comprising a cylindrical tube extending into the container and having an inner radius selected such that its inner surface can couple with a lower section extension of the straw.

Further representations illustrating examples of the retracting straw are shown in FIGS. 7C-E.

FIGS. 14A-14D show various views of a container according to another example of the hydration system. FIG. 14A illustrates a hydration system with an access flap in a closed configuration. The system comprises a container 1402, a sealing cap 1404, an access flap 1406 and a carrying hanger 1410. The access flap 1406 is hinged to the sealing cap 1404 via a connecting part 1412. A carrying hanger 1410 is also attached via the connecting part 1412. When in closed configuration, a hinge 1420 on the access flap 1406 attaches to another hinge 1408 on the sealing cap 1404. A locking handle 1414 on the hinge 1408 locks the access flap 1406 on the sealing cap 1404 when the locking handle 1414 is moved in an upward position and locked therein as shown in FIG. 14A. The locking handle 1414 is released from its locking position to hang downward to open the access flap 1406 as shown in FIG. 14B. The drinking straw 1418 having a flexible upper portion protrudes out from the access flap 1406 for convenient access by a drinker.

FIGS. 14C and 14D illustrate schematic cut-away representations 1400C and 1400D of the hydration system in a closed and an open configuration, respectively. The container system may further include a straw retention mechanism for holding the straw in place within the container. The straw retention mechanism is shown to have two parts, one for holding the lower straight part of the straw and another for holding the upper flexible part of the straw within the container when in closed configuration. As illustrated in the view 1400C, the lower part 1418' of the straw is held in its position within the container 1402 through a hinge or a clip 1424 provided inside the container 1402. The hinge or a clip 1424 may alternatively be provided inside the sealing cap 1406. The hinge or a clip 1424 enables the straw to remain in the vertical position inside the container. The upper flexible part 1418" of the straw is folded into the recess when in the closed configuration and held in its position through another part 1422 of the straw retention mechanism. The straw retention mechanism 1422 includes a downward protruding section comprising a cylindrical tube extending into the container and having an inner radius selected such that its inner surface can couple with flexible part 1418" of the straw. The flexible part 1418" of the straw protrudes out itself when the access flap is opened. This provides easy access to the contained liquid without touching the straw.

The above-mentioned straw retention mechanism is exemplary in nature and should not limit the scope of the invention.

Referring now to FIG. 8A which schematically represents a possible soft toy type hydration system 800 for incentivizing children to hydrate according to a second embodiment of the hydration system. The embodiment has the form of a fleecy doll 802 in the stylized shape of a bear. The soft toy 802 is characterized by the addition of a drinking nozzle 804 protruding from its head through which a liquid contained within may be drunk.

With further reference to FIG. 8B a schematic cut-away representation is shown of the soft toy 800 type hydration system of the second embodiment of the hydration system. The illustration has cut away the outer layers to reveal the internal reservoir chamber 806 containing liquid as well as a fluffy filling 808 between the reservoir walls 810 and the skin layer 812.

The reservoir chamber 806 of the hydration system 800 may be accessed for refilling via an opening therewithin. For example, according to some embodiments, the drinking nozzle 804 may be opened to provide access to the reservoir chamber for refilling in situ. Additionally, or alternatively an additional access opening may be provided for the reservoir chamber, such as an openable lid to provide a larger access point for filling the reservoir. Accordingly, various embodiments of the hydration system may include watertight sealable openings in the skin layer for accessing the reservoir chamber 806.

Referring now to FIGS. 9A and 9B, an alternative embodiment of the soft toy type hydration system 900 is shown for incentivizing children to hydrate. It is noted that in the alternative embodiment, the protruding nozzle 904 is connected to a plastic flange 914 formed from the upper surface of the lid of the reservoir chamber which also extends outside the skin layer 912 though a wide aperture.

With reference now to FIGS. 10A and 10B which show rear views 1000 and 1000' of the skin layer of the alterative soft toy type hydration system in the closed and open configurations, the wide aperture through which the nozzle and flange may protrude. It is further noted that access to the insides of the toy 1002 via a closable access opening 1004 at the back of the toy 1002. FIG. 10A illustrates the rear view 1000 of the embodiment in a closed configuration and FIG. 10B illustrates the rear view 1000' of the embodiment in an open configuration such that the interior of the toy 1002 is accessible. Where required the access opening may include a fastening system such as a zipper 510, hook-and-eye locking, buttons, Velcro® or the like, as suit requirements.

Furthermore, the FIGS. 10A, 10B and 10C show a stabilization element 1006 which may weighted such that the soft toy hydration system stands up when placed on a flat surface. The underside of the stabilization element may further include a gripping ring around its base which may have a high coefficient of friction with common surfaces. The addition of a stabilization element, gripping ring, disk or the like on the underside of the food container may make the container more stable particularly when used by the young ones.

It is appreciated that certain features of the invention, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

Although the invention has been described in conjunction with specific embodiments thereof, it is evident that other alternatives, modifications, variations and equivalents will be apparent to those skilled in the art. Accordingly, it is intended to embrace all such alternatives, modifications, variations and equivalents that fall within the spirit of the invention and the broad scope of the appended claims. Additionally, the various embodiments set forth hereinabove are described in terms of exemplary block diagrams, flow charts and other illustrations. As will be apparent to those of ordinary skill in the art, the illustrated embodiments and their various alternatives may be implemented without confinement to the illustrated examples. For example, a block diagram and the accompanying description should not be construed as mandating a particular architecture, layout or configuration.

The definitions provided herein are to facilitate understanding of certain terms used frequently herein and are not meant to limit the scope of the present disclosure.

As used in this specification and the appended claims, the singular forms "a", "an", and "the" encompass embodiments having plural referents, unless the content clearly dictates otherwise.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the term "or" is generally employed in its sense including "and/or" unless the content clearly dictates otherwise.

The invention claimed is:

1. A container system configured to contain solid or liquid foodstuff, the container system comprising:

a container configured to store the solid or liquid foodstuff, wherein the container comprises an integral container cap coupler;

a sealing cap comprising a bottle coupler integral to the lower part of the sealing cap, wherein the bottle coupler is configured for mechanically connecting to the container cap coupler to form a watertight seal for the container, and a head coupler integral to the upper part of the sealing cap; and a detachable head comprising a head cap coupler integral to the lower part of the detachable head, wherein the head cap coupler is configured for mechanically connecting to the head coupler of the sealing cap, wherein the container comprises a straw retention mechanism for holding a drinking straw in place within the container.

* * * * *